US010680339B2

(12) United States Patent
Ng et al.

(10) Patent No.: US 10,680,339 B2
(45) Date of Patent: Jun. 9, 2020

(54) LOW PROFILE OMNIDIRECTIONAL CEILING MOUNT MULTIPLE-INPUT MULTIPLE-OUTPUT (MIMO) ANTENNAS

(71) Applicant: Laird Technologies, Inc., Earth City, MO (US)

(72) Inventors: Kok Jiunn Ng, Perak (MY); Choon Chung Su, Perak (MY); Yen Siang Tan, Earth City, MO (US)

(73) Assignee: Laird Connectivity, Inc., Akron, OH (US)

( * ) Notice: Subject to any disclaimer, the term of this patent is extended or adjusted under 35 U.S.C. 154(b) by 176 days.

(21) Appl. No.: 15/935,881

(22) Filed: Mar. 26, 2018

(65) Prior Publication Data

US 2018/0309204 A1 Oct. 25, 2018

(30) Foreign Application Priority Data

Apr. 20, 2017 (MY) ..... PI2017701398

(51) Int. Cl.
*H01Q 1/38* (2006.01)
*H01Q 1/48* (2006.01)
(Continued)

(52) U.S. Cl.
CPC ..... *H01Q 9/16* (2013.01); *H01Q 1/38* (2013.01); *H01Q 1/48* (2013.01); *H01Q 1/521* (2013.01);
(Continued)

(58) Field of Classification Search
CPC ..... H01Q 1/241; H01Q 1/24; H01Q 1/38; H01Q 1/42; H01Q 1/48; H01Q 1/521;
(Continued)

(56) References Cited

U.S. PATENT DOCUMENTS 3,514,780 A * 5/1970 Ferrell, Jr. ..... H01Q 21/24 343/830
3,969,730 A * 7/1976 Fuchser ..... H01Q 1/42 343/770
(Continued)

*Primary Examiner* — Tho G Phan
(74) *Attorney, Agent, or Firm* — Harness, Dickey & Pierce, P.L.C.; Anthony G. Fussner

(57) ABSTRACT

Disclosed are exemplary embodiments of antennas that may be configured to be low profile, omnidirectional, ceiling mountable, and/or multiple-input multiple-output (MIMO). In an exemplary embodiment, an antenna generally includes first and second radiators and a ground plane. First and second edge portions of the ground plane may configured to be operable for reducing null at azimuth plane to thereby allow the antenna to have more omnidirectional radiation patterns for the azimuth plane. The antenna may be configured to have an asymmetrical perpendicular dipole configuration. A neutral line may be spaced apart from and proximity coupled to the ground plane. The ground plane may comprise first and second ground plane extension arms and/or a slant cutout defined between spaced-apart first and second lower portions of the ground plane. The ground plane may include a bridge portion extending between the spaced-apart first and second lower portions of the ground plane.

22 Claims, 14 Drawing Sheets

(51) Int. Cl.

| | |
|---|---|
| ***H01Q 9/16*** | (2006.01) |
| ***H01Q 5/30*** | (2015.01) |
| ***H01Q 21/28*** | (2006.01) |
| ***H01Q 9/04*** | (2006.01) |
| ***H01Q 1/52*** | (2006.01) |
| ***H01Q 9/28*** | (2006.01) |
| ***H01Q 21/24*** | (2006.01) |
| ***H01Q 5/364*** | (2015.01) |
| *H01Q 1/24* | (2006.01) |
| *H01Q 1/42* | (2006.01) |

(52) U.S. Cl.
CPC ..... *H01Q 5/30* (2015.01); *H01Q 5/364* (2015.01); *H01Q 9/0407* (2013.01); *H01Q 9/285* (2013.01); *H01Q 21/245* (2013.01); *H01Q 21/28* (2013.01); *H01Q 1/241* (2013.01); *H01Q 1/42* (2013.01)

(58) Field of Classification Search
CPC ..... H01Q 9/06; H01Q 9/065; H01Q 9/0407; H01Q 9/16; H01Q 9/285; H01Q 21/245; H01Q 21/28
See application file for complete search history.

(56) References Cited

U.S. PATENT DOCUMENTS

| | | | | |
|---|---|---|---|---|
| 5,654,724 | A * | 8/1997 | Chu | H01Q 9/38 343/742 |
| 5,771,025 | A * | 6/1998 | Reece | H01Q 1/38 343/789 |
| 6,018,324 | A * | 1/2000 | Kitchener | H01Q 1/38 343/702 |
| 6,950,066 | B2 * | 9/2005 | Hendler | H01Q 9/36 343/700 MS |
| 2005/0162321 | A1 * | 7/2005 | Colburn | H01Q 1/243 343/702 |
| 2017/0324167 | A1 | 11/2017 | Ng et al. | |
| 2018/0062731 | A1 | 3/2018 | Ng et al. | |

* cited by examiner

LOW PROFILE OMNIDIRECTIONAL CEILING MOUNT MULTIPLE-INPUT MULTIPLE-OUTPUT (MIMO) ANTENNAS

CROSS-REFERENCE TO RELATED APPLICATION

This application claims priority to and the benefit of Malaysian Patent Application No. PI 2017701398 filed Apr. 20, 2017. The entire disclosure of the above application is incorporated herein by reference.

FIELD

The present disclosure relates to low profile omnidirectional ceiling mount MIMO antennas.

BACKGROUND

This section provides background information related to the present disclosure which is not necessarily prior art.

In-building cellular network applications may require a multiple-input multiple-output (MIMO) antenna that is ultra-low profile and aesthetic looking for the building ceiling. Conventionally, this antenna type has been designed with a dipole parallel to the ceiling, which tends to have a very large dip or null that is not omnidirectional in azimuth plane.

DRAWINGS

The drawings described herein are for illustrative purposes only of selected embodiments and not all possible implementations, and are not intended to limit the scope of the present disclosure.

Figure 6A:
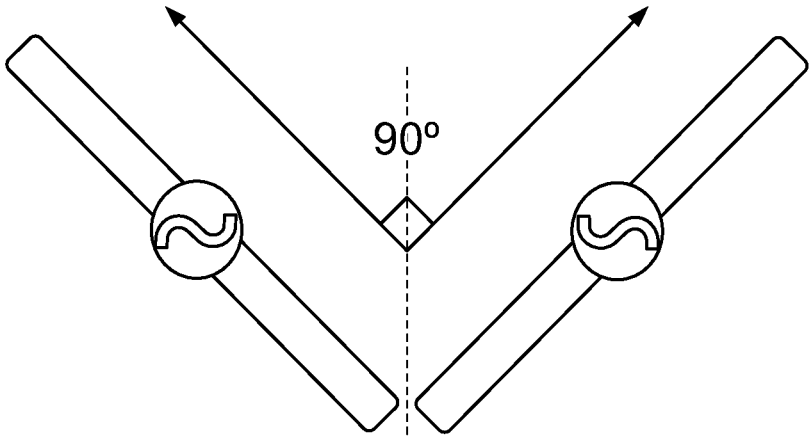
Figure 6B:
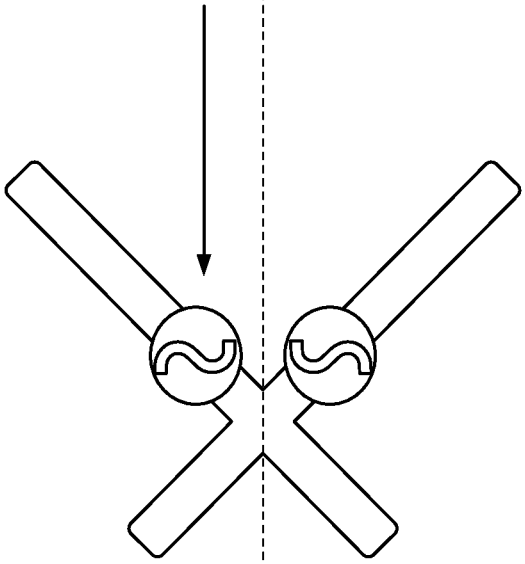
Figure 6C:
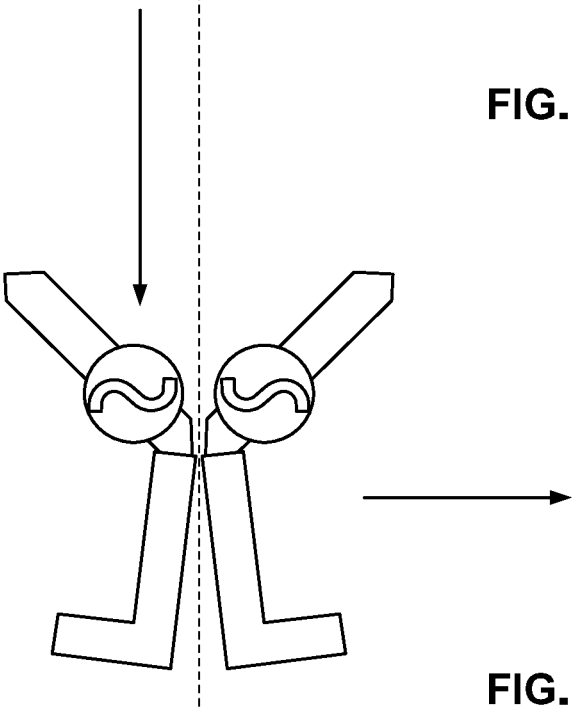
Figure 6D:
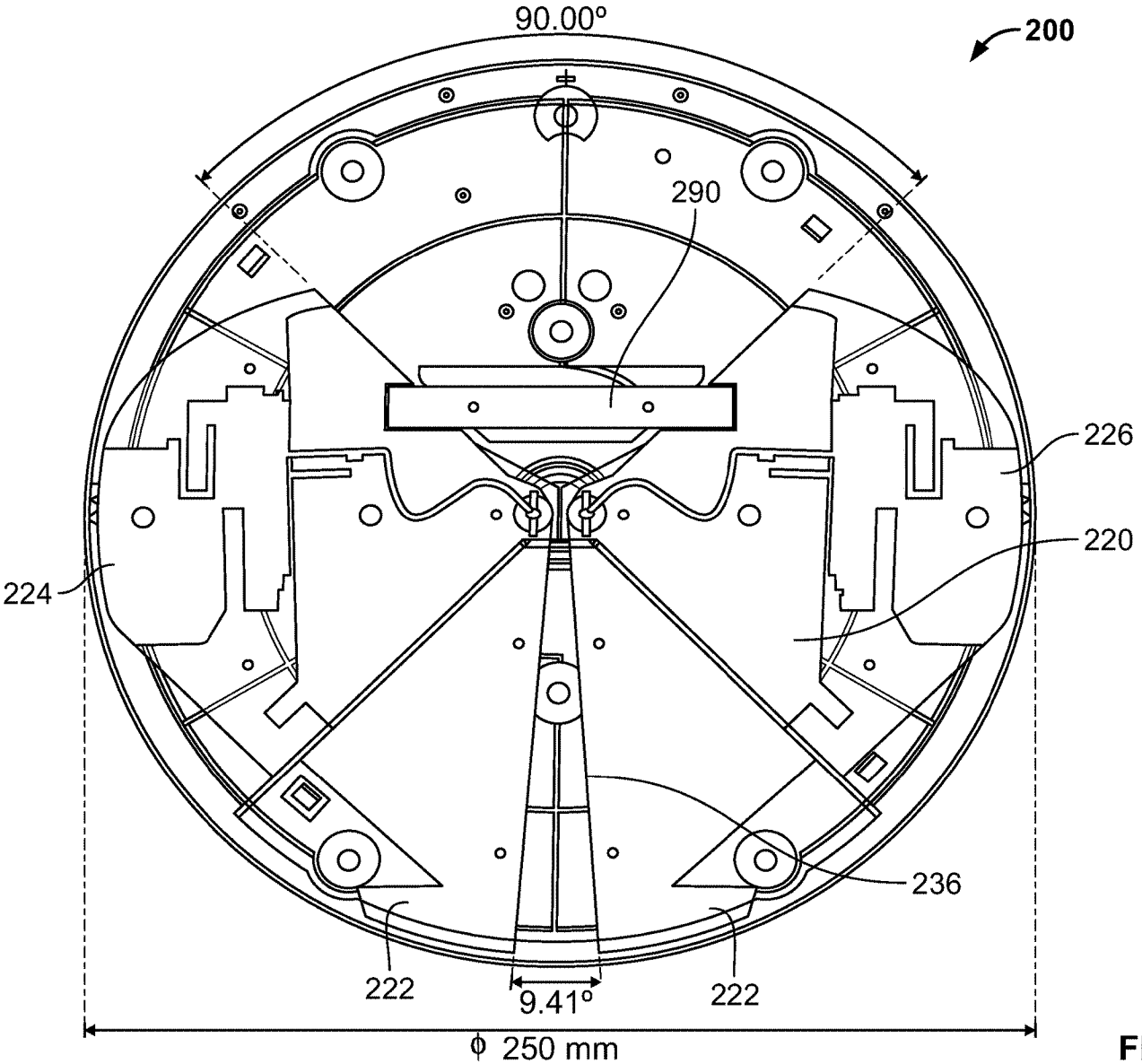

FIGS. 6*a*, 6*b*, and 6*c* illustrate mirror images about a mirror plane;

FIGS. 6(*d*) and 7 illustrate an antenna according to another exemplary embodiment that includes a printed circuit board (PCB) having radiators with additional steps for improved VSWR and bandwidth. The dimensions are provided in FIG. 6(*d*) for purposes of illustration only according to an exemplary embodiment.

Figure 8:
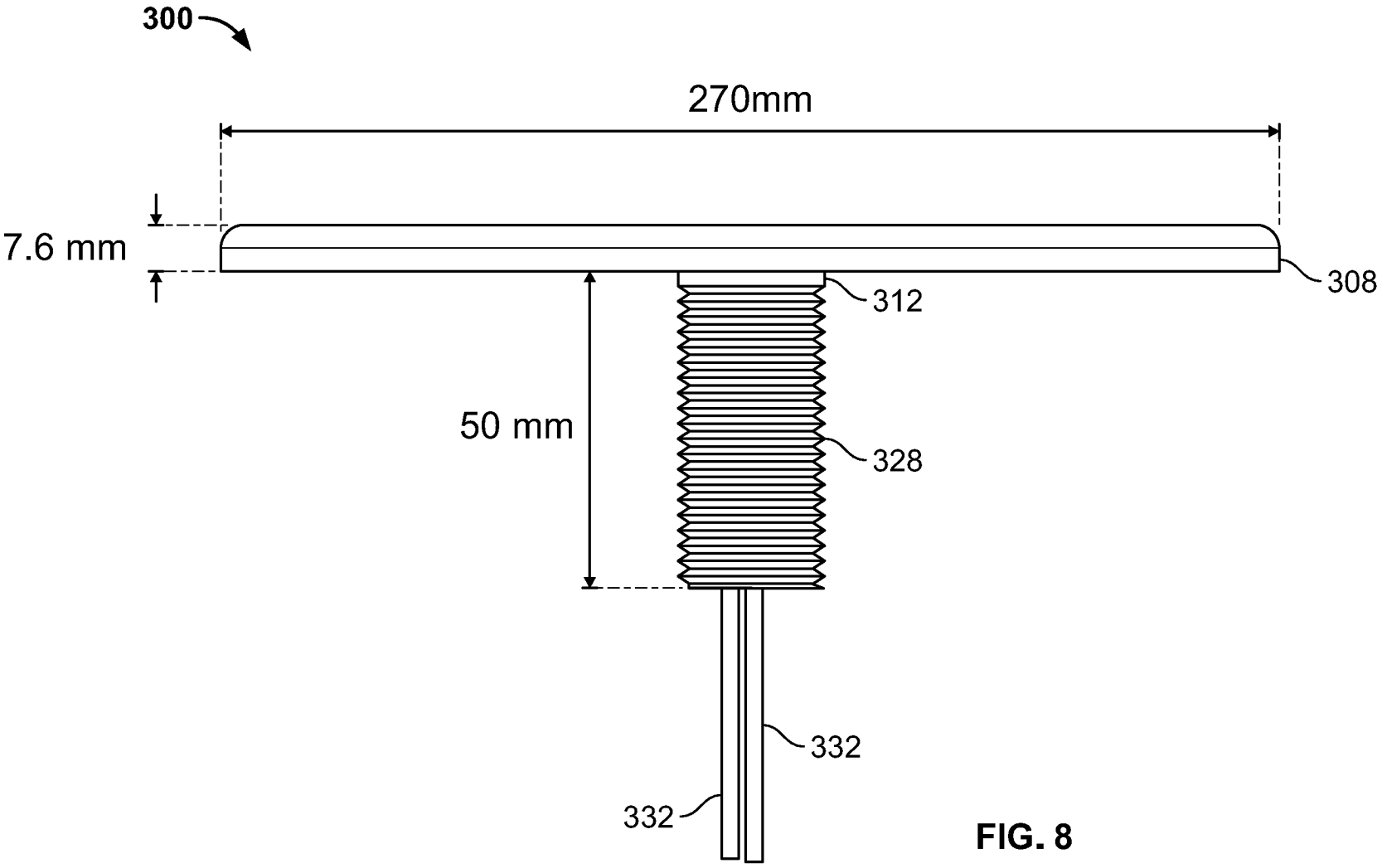

FIG. 8 is a perspective view of an antenna according to another exemplary embodiment. Example dimensions in millimeters (mm) are provided in FIG. 8 for purposes of illustration only.

Figure 9:
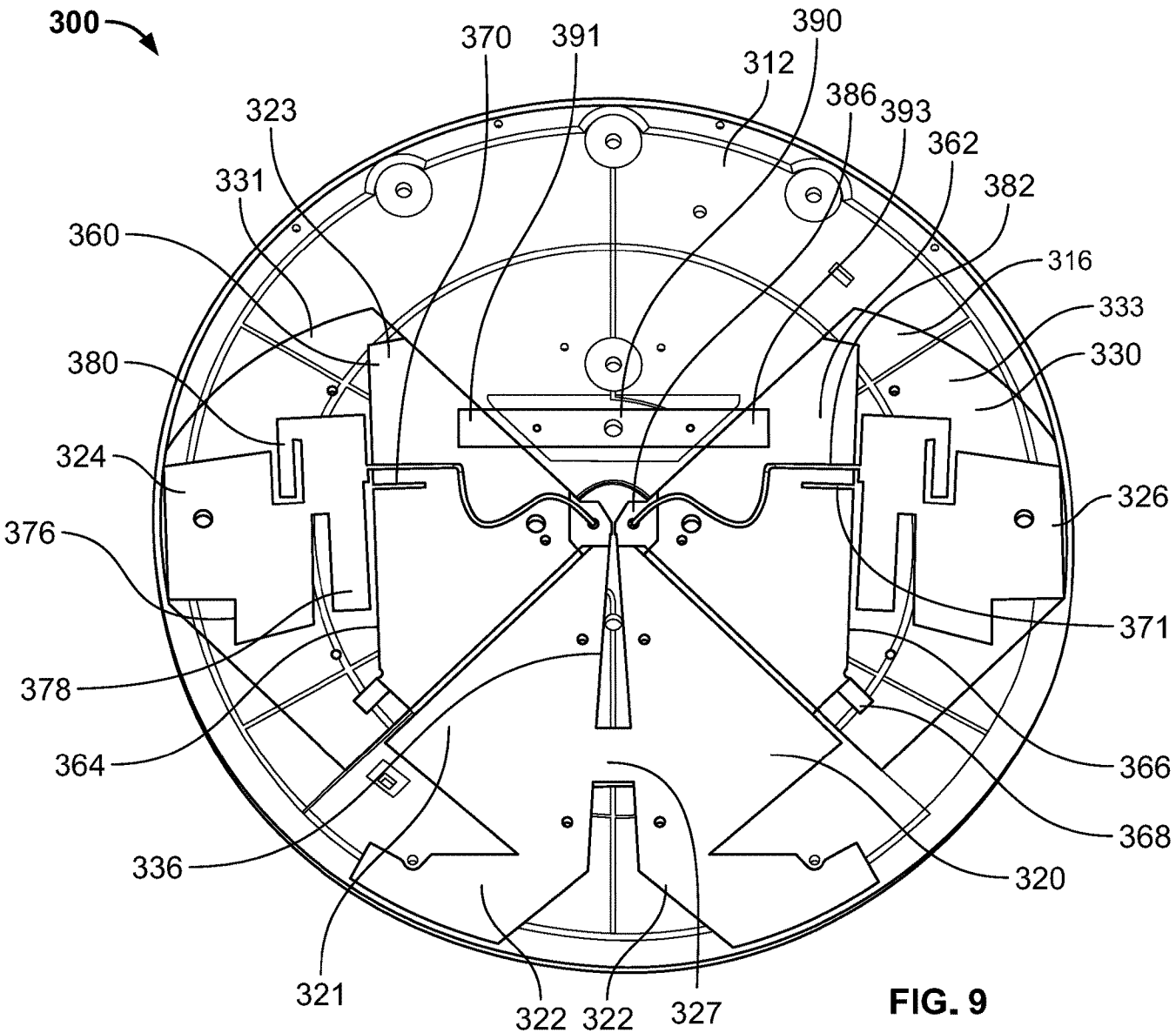

FIG. 9 illustrates a printed circuit board (PCB) and baseplate that may be used with the antenna shown in FIG. 8 according to an exemplary embodiment.

Figure 7:
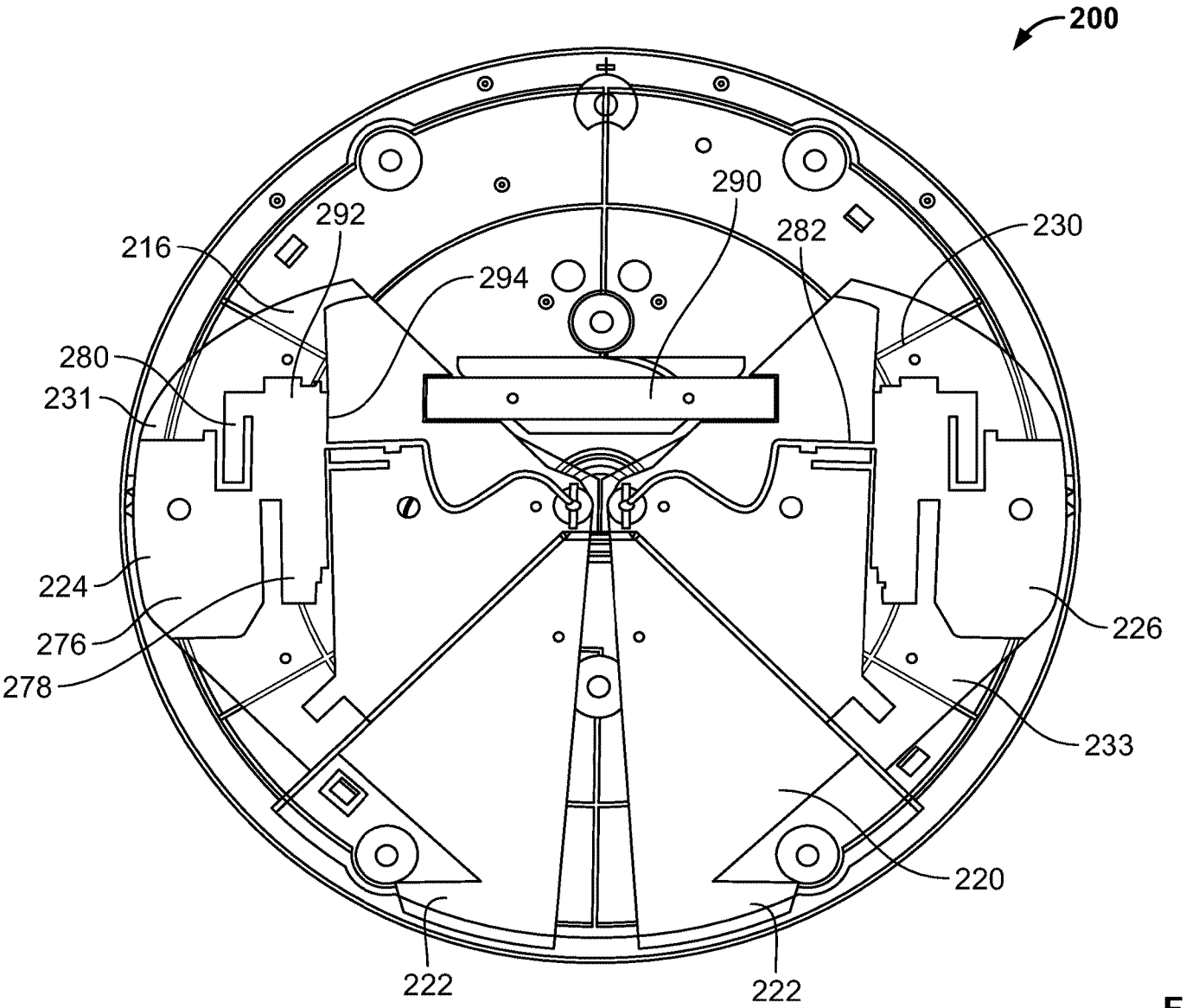
Figure 10:
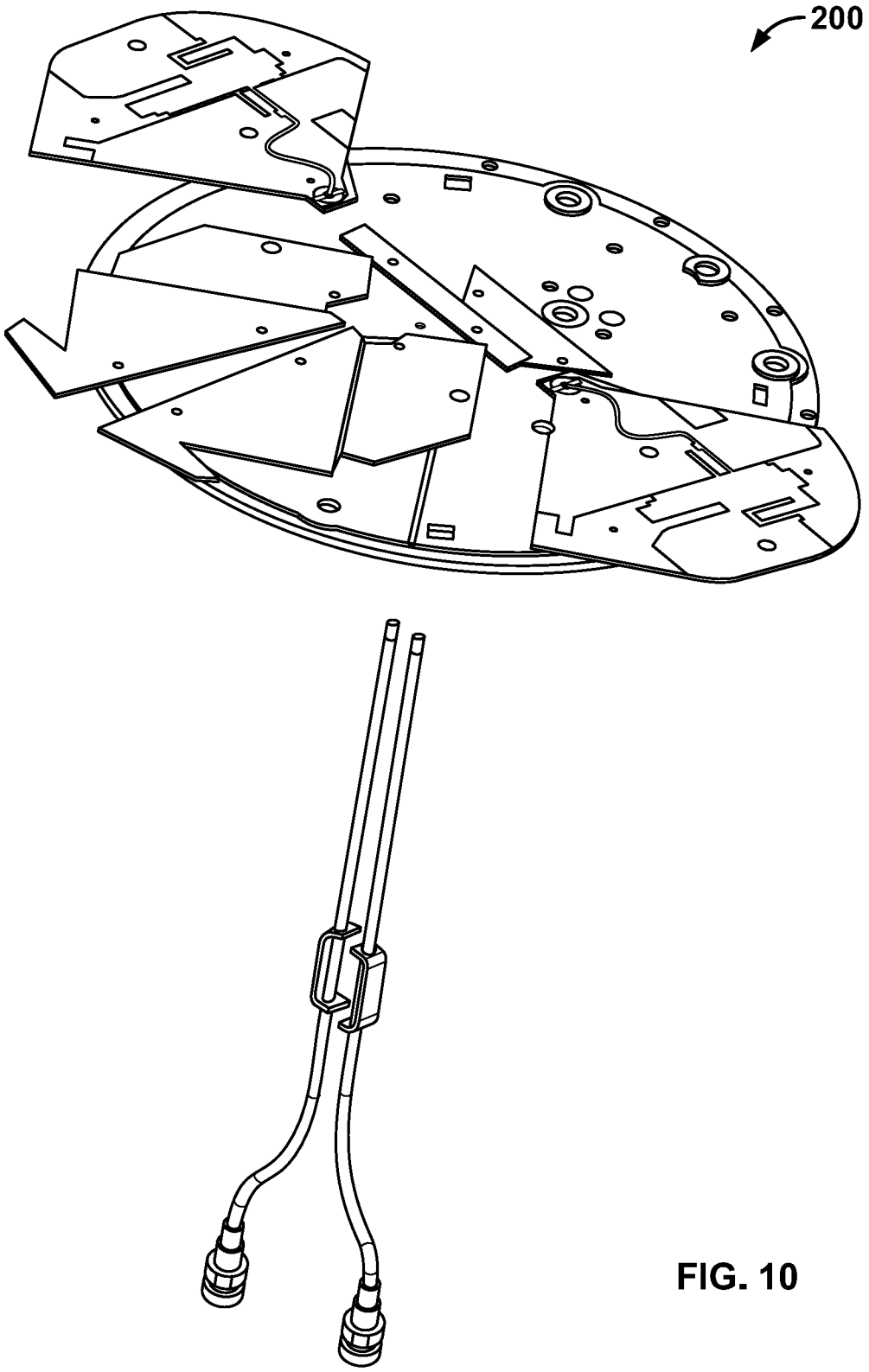
Figure 11:
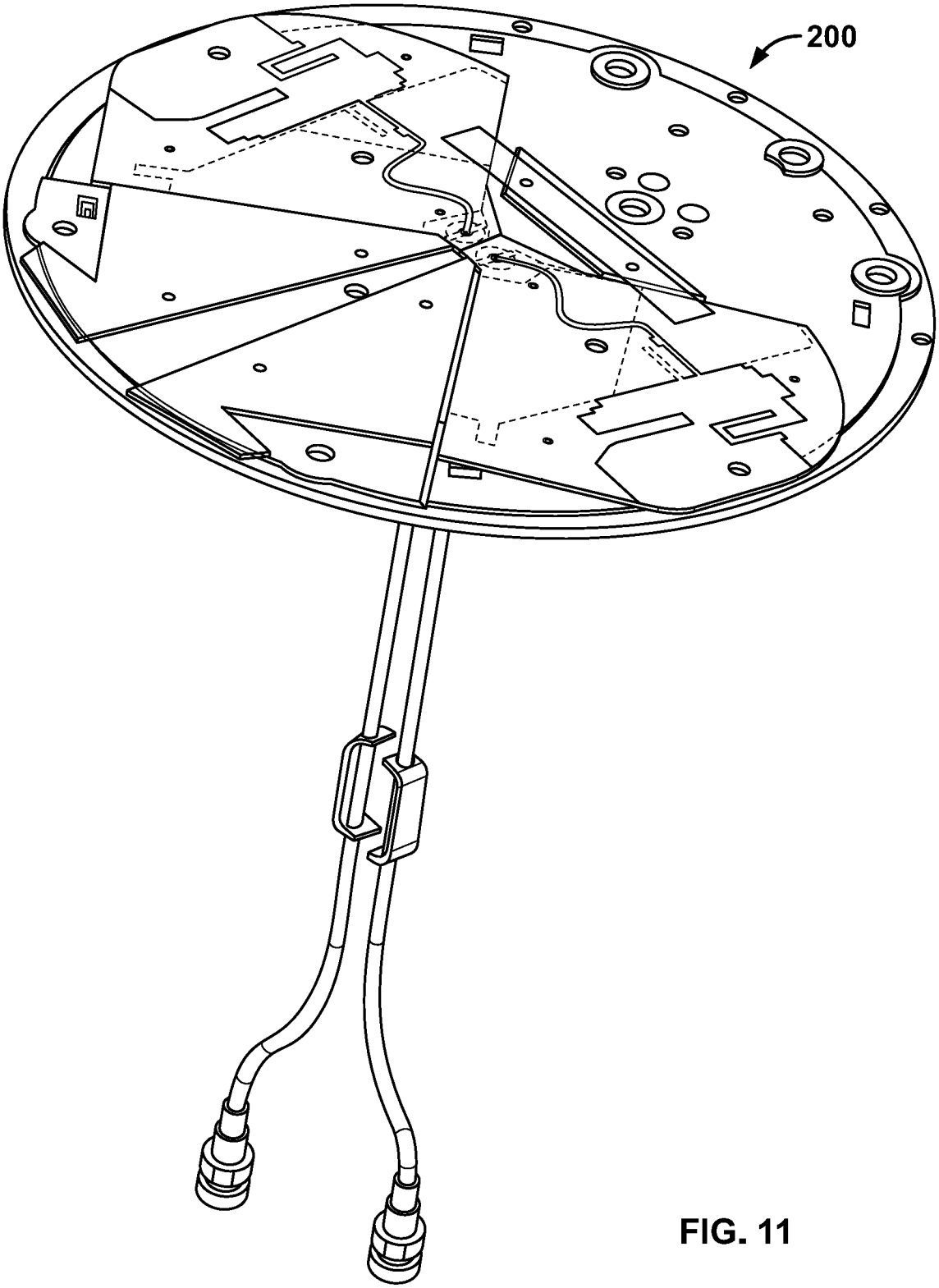

FIGS. 10 and 11 illustrate an exemplary multi-component construction of the antenna shown in FIGS. 6 and 7 according to an exemplary embodiment in which there are multiple PCBs.

Figure 12:
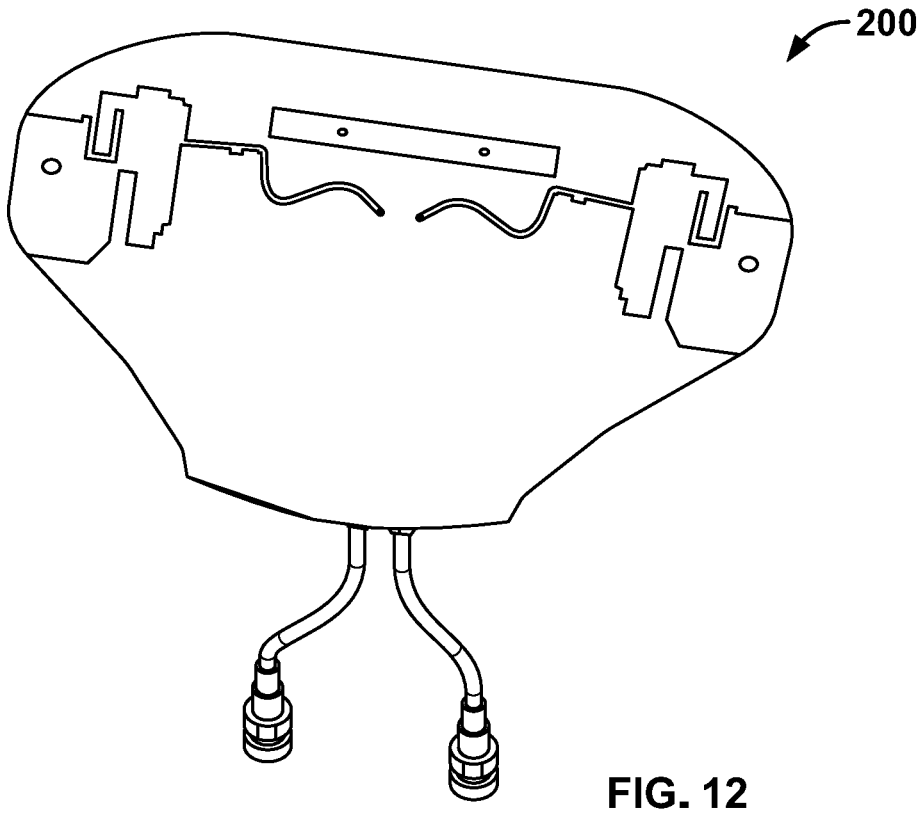
Figure 13:
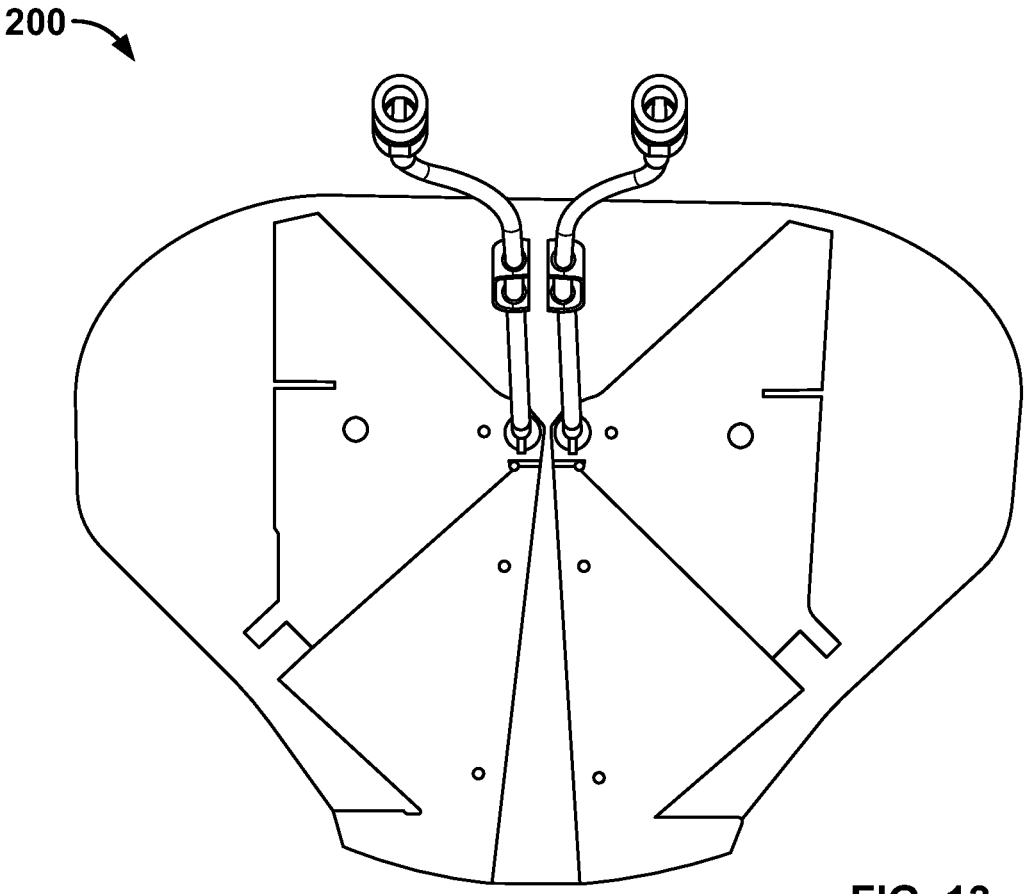

FIGS. 12 and 13 illustrate an exemplary single PCB construction of the antenna shown in FIGS. 6 and 7 according to an exemplary embodiment in which there are multiple components on a single PCB.

Figure 14:
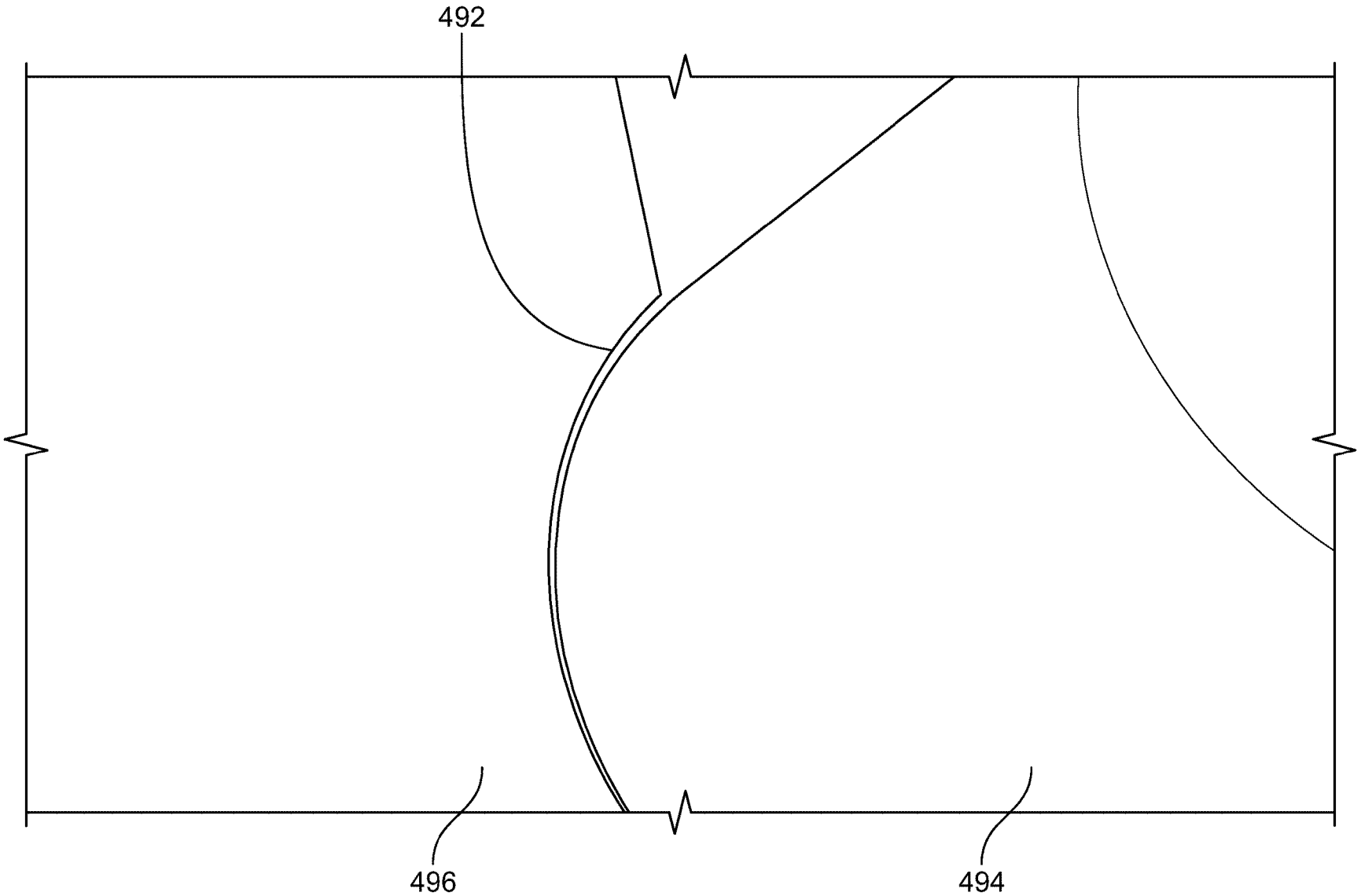

FIG. 14 illustrates a gap defined between a cable braid and a soldering pad that may be used with an antenna according to an exemplary embodiment.

Figure 15:
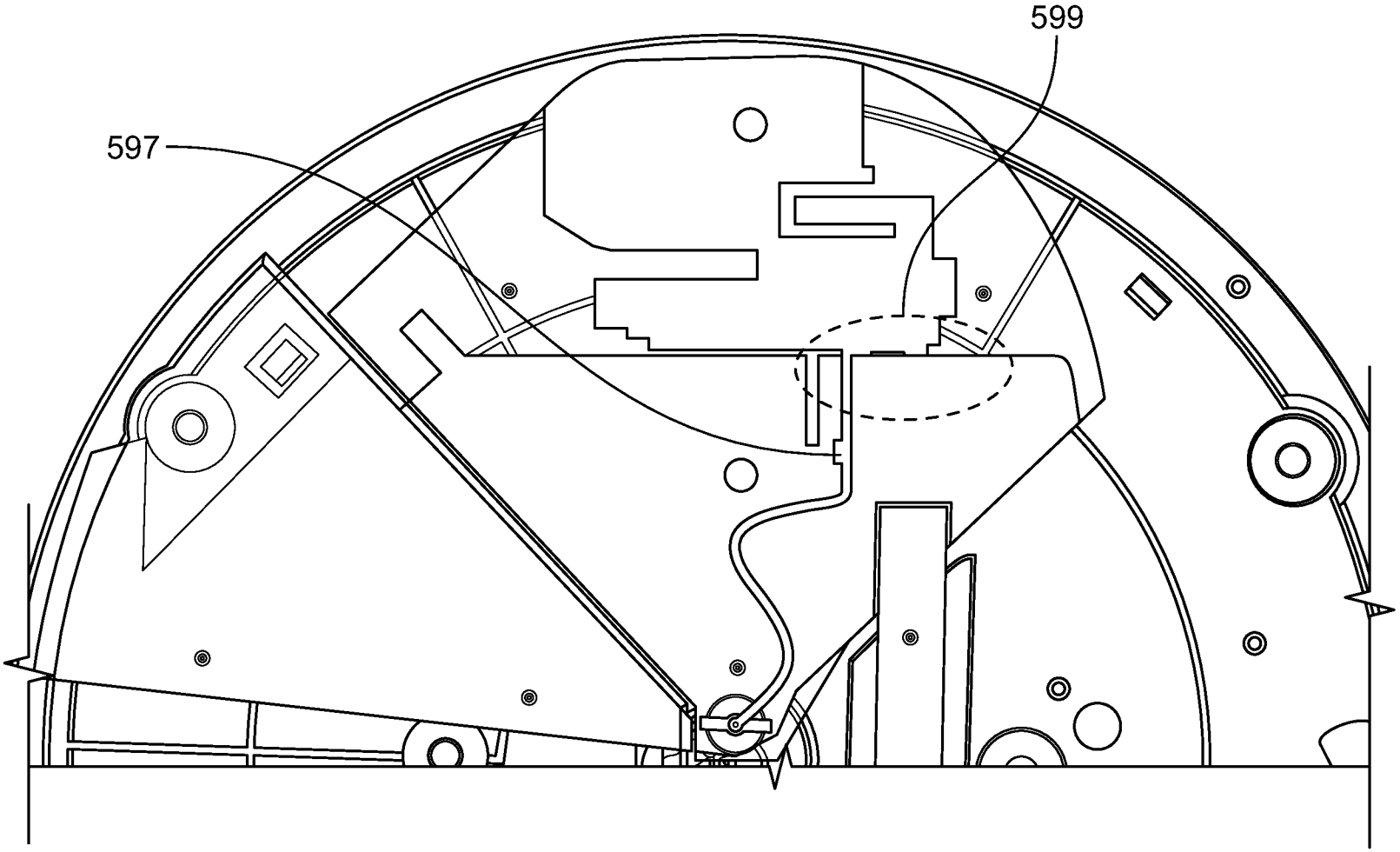

FIG. 15 illustrates radiators with additional steps for improved VSWR and bandwidth and stub matching that may be used with an antenna according to an exemplary embodiment.

Corresponding reference numerals indicate corresponding parts throughout the several views of the drawings.

DETAILED DESCRIPTION

Example embodiments will now be described more fully with reference to the accompanying drawings.

Disclosed herein are exemplary embodiments of antennas that may be configured to be low profile (e.g., an ultra-low profile with a height of about 7.6 millimeters or less, etc.), omnidirectional, ceiling mountable (e.g., for in-building cellular network applications, etc.), multiple-input multiple-output (MIMO) (e.g., having two or more ports, etc.), and/or operable with low passive intermodulation (PIM). By way of example, an exemplary embodiment of an antenna may be configured for multiband operation within at least a first frequency range (e.g., from about 698 MHz to about 960 MHz, from about 600 MHz to about 960 MHz, etc.) and a second frequency range (e.g., from about 1690 MHz to about 3800 MHz, from about 1350 MHz to about 4200 MHz, from about 1350 MHz to about 6000 MHz, etc.) different than the first frequency range. Alternatively, another exemplary embodiment of an antenna may be configured to be operable within a relatively wide frequency range or wideband (e.g., from about 600 MHz to about 6000 MHz, across most of the Long Term Evolution (LTE) band, etc.).

In exemplary embodiments, the antenna includes first and second radiators and a ground plane positionable within an interior cooperatively defined between a radome and a baseplate or support member. By way of example, the baseplate and radome may be circular with a diameter of about 250 mm (e.g., FIG. 3, etc.) or about 270 mm (e.g., FIG. 8, etc.). The baseplate may include a threaded stud feature (broadly, a mounting feature or fixture) for installing the antenna to a ceiling (broadly, a mounting surface). The radiators may comprise PCB radiators, stamped radiators, flexible PCB radiators, electrically-conductive tape, combination thereof, etc. For example, the antenna may include first and second radiators and a ground plane (broadly, a ground element) along opposite first and second (or front and back) sides of a PCB (broadly, a substrate). The antenna may comprise first and second radiators, antenna elements, or dipoles that are symmetrical and perpendicular to each other with a 90 degree angle between the dipoles (e.g., FIG. 6*d*, etc.).

In exemplary embodiments, the antenna may include asymmetrical arms and thus is not a typical dipole antenna having symmetrical arms. The longer asymmetrical arm may be referred to as a ground plane while the other asymmetrical arm may be referred to as the radiator. In exemplary embodiments, the antenna may have a symmetrical design between two ports and have similar radiation patterns in opposite directions with reference to a mirror plane.

Several factors play important roles to have reduced null and more omnidirectional radiation patterns at azimuth plane for horizontal planar asymmetrical dipole antennas as disclosed herein:

- ratio of the length between the radiator and the ground plane;
- the edge angle of the ground plane against the radiator;
- the location of the feeding point; and
- the length of one of the radiator arms.

There are also several factors to maintain the reduced null and more omnidirectional radiation patterns at azimuth plane for a horizontal planar asymmetrical dipole antenna while broadbanding the antenna bandwidth:

- wide arm or ground plane of the antenna;
- coupling between the arm and the ground plane or multiple step gap;
- impedance matching via a slot introduced to an edge of the ground plane that overlaps or is adjacent the radiator;
- with or without a slot introduced adjacent the solder location of the feeding cable; and
- width and length of the transmission line.

Regarding the introduction of slots adjacent the solder locations of the feeding cables, the slots may be added to help impedance matching for higher band. Slot orientation also impacts the matching to the antenna. The antenna may include or not include such slots depending on the match of the antenna as the ratio arm can vary and the gap design can be slightly different.

There are several factors to lengthen the antenna electrically without significantly increasing antenna size when having a lower frequency option to cover frequencies from 600 MHz:

- slight lengthening of the trace defining the ground plane that is bent outwardly in the orientation that does not increase the overall size much; and
- extension of the radiator.

The slant angle of the ground plane is carefully adjusted to maintain the isolation performance.

There are several factors that lower the risk of high PIM level:

- using pigtail coaxial cable option instead of a fixed connector as the fixed connector may be more difficult to implement to a PCB and have less freedom for matching the antenna;
- slot(s) at the feeding ground point to reduce soldering surface; and
- pull back copper to prevent direct galvanic contact of the cable braid to the copper layer of the PCB from the soldering to help ensure stable PIM performance.

Regarding the arrangement and placement of two radiators effect on the isolation:

- mirror of the radiator allows symmetrical radiation pattern;
- slant cut out of the ground plane allows radiator placement closer to each other;
- the radiator is mirrored to have a perpendicular dipole arrangement with 90 degree between the dipoles; and
- introduction of a proximity coupling neutral line improve isolation for the low band; and
- extension of the ground arm outwardly allows for reduced size of the antenna.

Accordingly, disclosed herein are exemplary embodiments of antennas that may have or provide one or more of the following features or advantages over conventional dipole antennas. For example, an antenna disclosed herein may have less null at azimuth plane as compared to a conventional dipole. An antenna disclosed herein may also have a wide bandwidth, may enable a stable low PIM product, and/or may have a lower profile as compared to other conventional antennas. An antenna disclosed herein may be configured to be operable with a symmetrical radiation pattern between two ports at mirror plane and/or with good isolation performance between the ports.

With reference now to the figures, FIGS. 1 through 6 illustrate an exemplary embodiment of an antenna 100 embodying one or more aspects of the present disclosure. In this exemplary embodiment, the antenna 100 comprises a low profile omnidirectional ceiling mount MIMO antenna across or within a first or low frequency range or bandwidth (e.g., from about 698 Megahertz (MHz) to about 960 MHz, etc.) and a second or high frequency range or bandwidth (e.g., from about 1350 MHz to about 4200 MHz, etc.).

Figure 3:
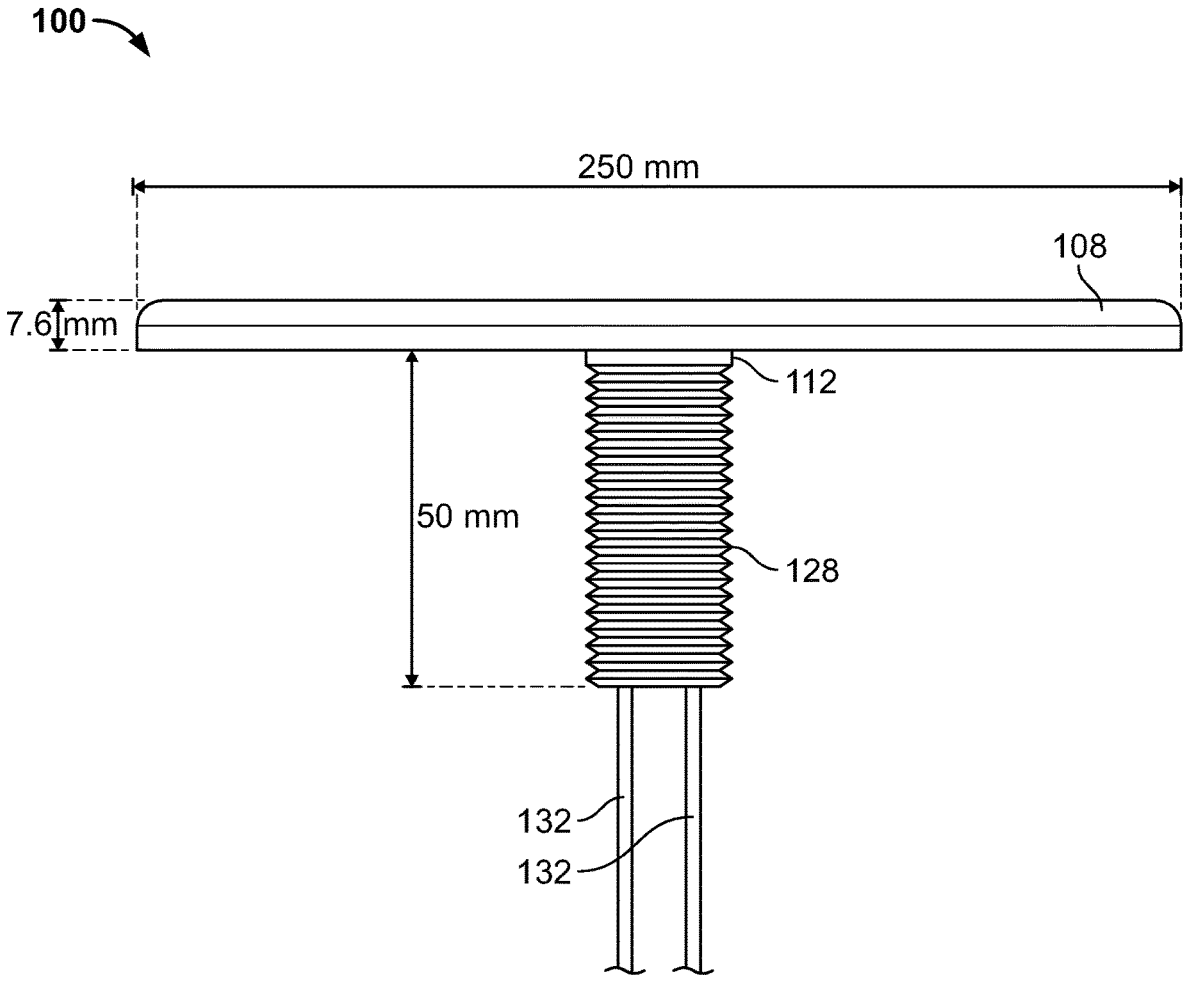
FIG. 3 is another perspective view of the antenna shown in FIG. 1 with example dimensions in millimeters (mm) that are provided for purposes of illustration only according to an exemplary embodiment.

The antenna 100 includes a radome or cover 108 (e.g., a plastic flat round or circular radome, etc.) and a baseplate or support member 112 (e.g., plastic baseplate, etc.). FIG. 3 provides exemplary dimensions (in millimeters) for the radome 108 and baseplate 112, respectively. As shown in FIG. 3, the radome 108 is circular with a diameter of 250 mm and low profile with a height of 7.6 mm. The baseplate 112 is also circular with a diameter of 250 mm. The dimensions in this paragraph (and elsewhere in this application and the drawings) are provided for purposes of illustration only according to exemplary embodiments as alternative embodiments may be configured differently, e.g., smaller, larger, etc.

Figure 2:
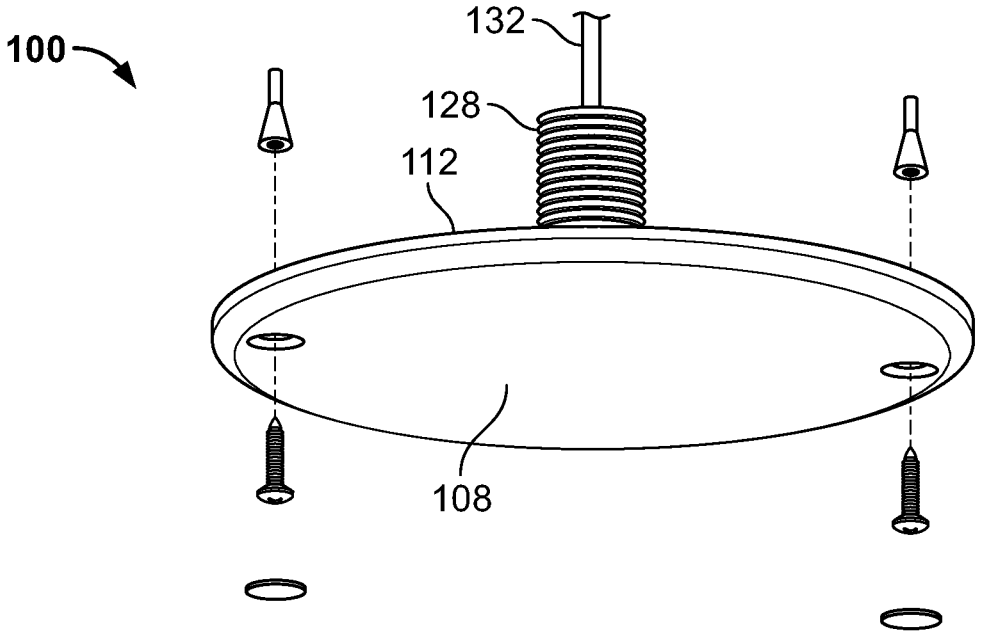
FIG. 2 is another perspective view of the antenna shown in FIG. 1.
Figure 4:
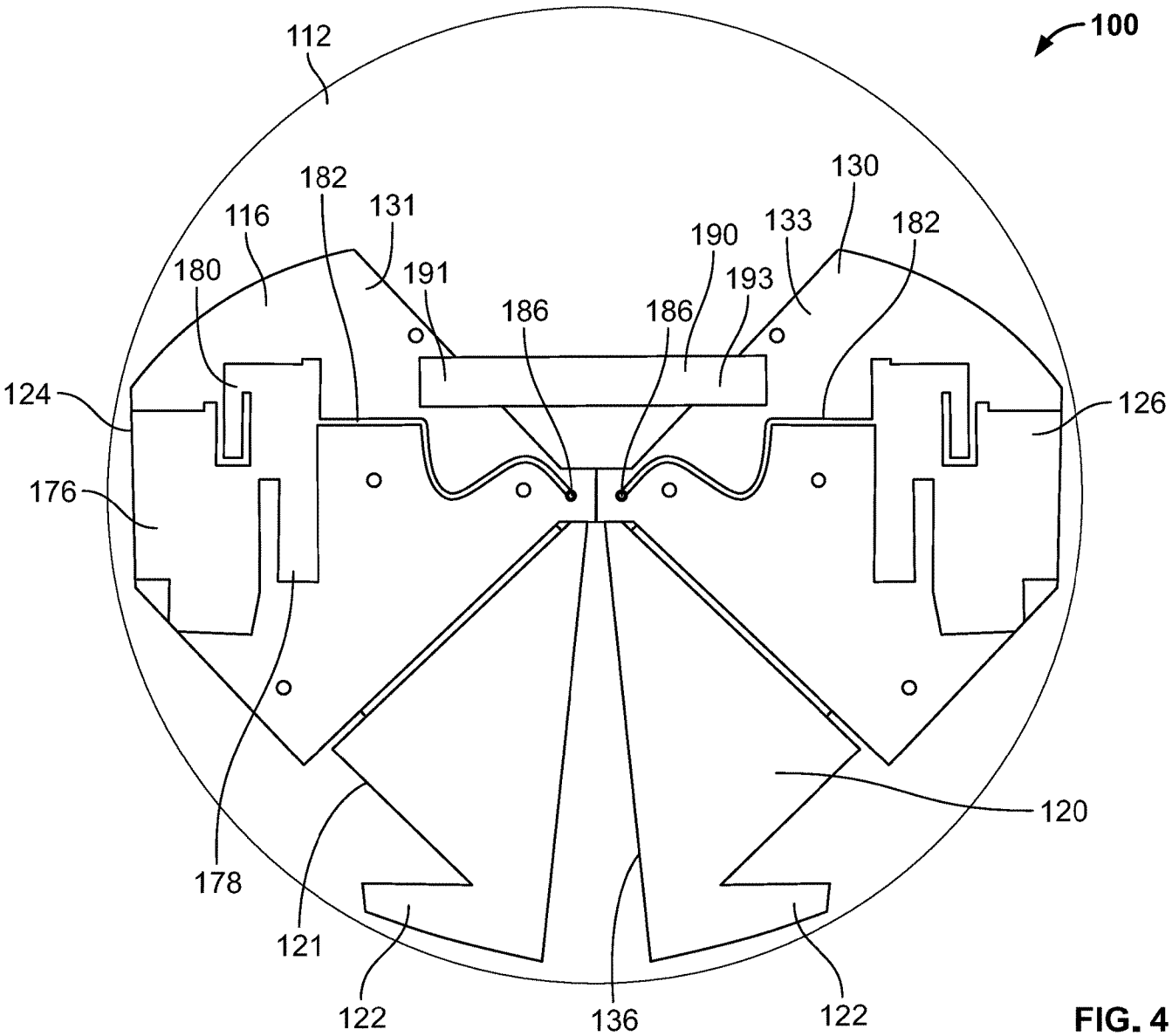
FIGS. 4 and 5 are top and bottom (or front and back) views of a printed circuit board (PCB) that may be used with the antenna shown in FIG. 1 according to an exemplary embodiment.
Figure 5:
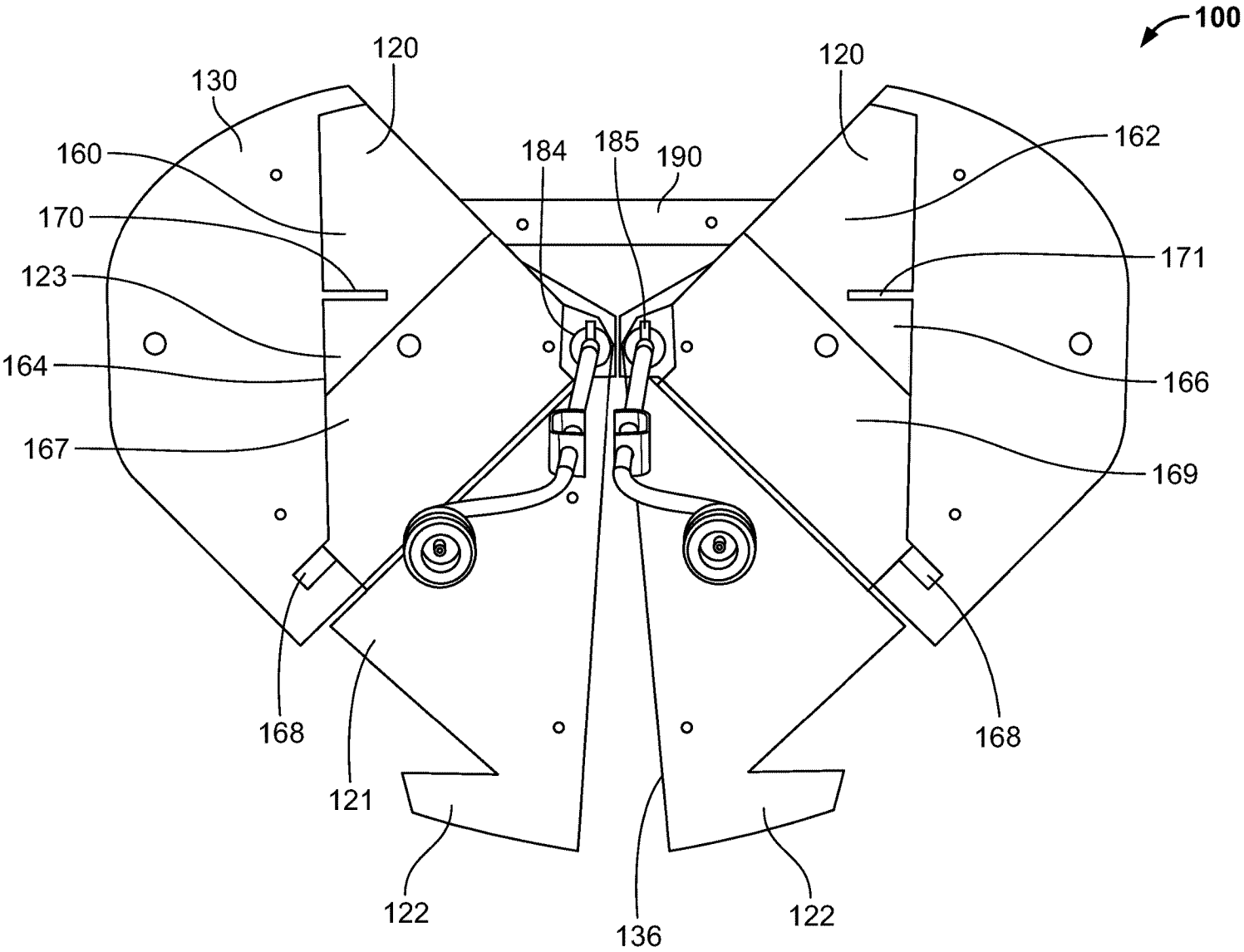

The radome 108 and baseplate 112 cooperatively define an interior in which a printed circuit board (PCB) 116 is positioned as shown in FIGS. 4 and 5. As shown in FIG. 2, the radome 108 may include two screw holes that may be provided based on a specific customer's bill of entry (BOE). FIG. 2 also illustrates screws and anchors for mounting the antenna 100 to a mounting surface such as a ceiling tile, etc.

The baseplate 112 may be configured for holding the antenna components. The radome 108 and baseplate 112 are configured to protect the PCB 116 and electrically-conductive elements (e.g., ground plane 120, ground plane extension arms 122, antenna elements or radiators 124 and 126, microstrip lines 182, neutral line 190, etc.) from damage, e.g., due to environmental conditions, etc. The radome 108 and baseplate 112 may be formed from a wide range of materials, such as, for example, thermoplastic materials (e.g., polycarbonate blends, Acrylonitrile-Butadiene-Styrene (ABS), Polycarbonate-Acrylonitrile-Butadiene-Styrene Copolymer (PC/ABS) blend, etc.), glass-reinforced plastic materials, synthetic resin materials, other dielectric materials, etc. within the scope of the present disclosure.

The baseplate 112 includes a threaded stud feature 128 (broadly, a mounting feature or fixture) for installing the antenna 100 to a ceiling (broadly, a mounting surface) with a plastic nut. In this example, the baseplate 112 may integrally include the threaded stud feature 128 such that the baseplate 112 and threaded stud feature 128 have a single-piece construction. Alternatively, the threaded stud feature 128 may instead be attached (e.g., adhesively attached, mechanically fastened, etc.) to the baseplate 112.

The threaded stud feature 128 is generally hollow such that two feed cables 132 (e.g., coaxial cables, other transmission lines, etc.) may be fed through the hollow interior of the threaded stud feature 128 to respective feed locations or points 184 (FIG. 5) of the antenna 100. The feed cables 132 may be low PIM rated coaxial cables to feed the antenna 100 for better PIM performance and low PIM rating. Alternatively, the feed cables 132 may be standard coaxial cables to feed the antenna 100 for a standard version of the antenna. By way of example, the feed cables 132 may comprise coaxial cables having a 30 centimeter or 12 inch length with type N-female/4.3-10 female connectors. As shown in FIGS. 4 and 5, the feed points 184 may be located at or towards a center of the radome 108 and baseplate 112. This allows the feed points 184 to be located within or overlap the hollow interior of the threaded stud feature 128. In this exemplary embodiment, the threaded stud feature 128 may be located at the center. This allows the antenna 100 to be installed in various orientations without impacting the outlook from the ceiling, which is unlike any rectangle form factor. By way of example, a system integrator may reorient or change the orientation of the antenna to optimize or at least improve the coverage and trouble shoot on the PIM due to the installation environment.

Antenna radiating elements or radiators 124, 126 (FIG. 4) and a ground plane 120 (FIG. 5) are along opposite first and second (or front and back) sides of a substrate 130 of the PCB 116. Also shown in FIGS. 4 and 5 are a proximity coupling neutral line 190 and ground plane extension arms 122. In this exemplary embodiment, the PCB 116 may be configured (e.g., shaped, split, have a bowtie or butterfly shape defined by first and second PCB portions 131 and 133, etc.) to reduce the amount of PCB material to thereby help reduce wastage and costs. The electrically-conductive surfaces (e.g., radiating elements 124, 126, ground plane 120, etc.) shown in FIGS. 4 and 5 may be fabricated or incorporated in a single PCB. See, for example, FIGS. 12 and 13 illustrating an exemplary single PCB construction of the antenna 200 shown in FIGS. 6 and 7 according to an exemplary embodiment in which there are multiple components on a single PCB. In such embodiment, a neutral line may be configured to have direct galvanic contact with a ground plane.

As shown in FIG. 5, the ground plane 120 may include a slant cutout 136 that may allow the radiating elements 124, 126 to be positioned closer to each other. The slant cutout 136 may be defined between spaced-apart first and second lower portions of the ground plane 120.

The ground plane extension arms 122 may be configured to lower or reduce the lower operating frequency of the antenna 100. The lower portion 121 of the ground plane 120 and the ground plane extension arms 122 may comprise electrically-conductive tape and/or foil (e.g., aluminum foil tape, etc.). The electrically-conductive tape and/or foil may be proximity ground coupled to and partially overlapping the upper portion 123 of the ground plane 120 (FIG. 5) on the PCB 116. For example, FIG. 5 shows the portions 167 and 169 overlapping the ground plane 120 on the PCB 116. Accordingly, the ground plane 120 may comprise the first or upper portion 123 defined by a ground plane on the PCB 116 and the second or lower portion 121 and extension arms 122 defined by electrically-conductive tape and/or foil (e.g., aluminum foil tape, etc.). Alternatively, the second or lower ground plane portion 121 and ground plane extension arms 122 may comprise a ground plane on the PCB 116 or another PCB.

The ground plane 120 may be configured with a slant cutout or angle 136 (e.g., 9.41° as shown in FIG. 6, etc.) therebetween, with a low overlap, and without being directly connected. The slant angle 136 may be determined (e.g., optimized, etc.) for better isolation. The ground plane extension arms 122 may be disposed within a relatively limited area and configured with dimensions and angles so as to not affect the isolation between the first and second radiators or antenna radiating elements 124, 126.

FIG. 6(*a*) shows a conventional arrangement of two dipole elements that are perpendicular to each other with one the edge arms closer to each other. This conventional arrangement may be used to improve isolation. But the overall size or footprint of the antenna may be too large and thus undesirable. FIG. 6(*b*) shows two dipole elements stacked to each other, which may be relatively easy to implement for a narrower band type of dipole. But dipoles that have a very wideband operation tend to have wide arms. FIG. 6(*c*) shows how the dipole arms may be bent at certain angles such that there is a different varying distance of gap between the two arms. But the isolation between the dipole arms may suffer from their mutual coupling. FIGS. 4 and 6(*d*) show a relatively wide arm with a slanted ground plane 120, 220, respectively, that help improve radiation pattern omnidirectionality at azimuth plane. The ground plane 120, 220 may include a slant cutout 136, 236, respectively, that may allow the respective radiating elements 124 and 126 or 224 and 226 to be positioned closer to each other. The slant cutout 136, 236 may be defined between spaced-apart first and second lower portions of the respective ground plane 120, 220.

As shown in FIG. 6(*d*), the arrangement is symmetrical with the dipoles perpendicular to each other with 90 degrees therebetween, such that the antenna 200 has a perpendicular dipole arrangement. As shown in FIG. 4, the first and second radiators 124, 126 (and feedlines 182) are configured to be mirror images of each other, such that the first radiator or antenna element 124 is a mirror image (in a mirror plane) of the second radiator or antenna element 126. The first and second antenna elements 124, 126 may appear almost identical but be reversed in a direction perpendicular to a mirror surface. Accordingly, the first radiator 124 may correspond in mirror image relation to the second radiator 126.

As shown in FIG. 5, the ground plane 120 includes first and second (or left and right) ground plane portions 160, 162 configured to be mirror images of each other, such that the first ground plane portion 160 corresponds in mirror image relation to the second ground plane portion 162. The ground plane extension arms 122 may also be configured to be mirror images of each other. First and second (or left and right) PCB portions 131, 133 of the PCB substrate 130 may also be configured to be mirror images of each other, such that the first PCB portion 131 corresponds in mirror relation to the second PCB portion 133. With a perpendicular dipole arrangement with mirrored radiating and ground plane elements, the antenna 100 may thus be configured to be operable with a symmetrical radiating pattern between two ports at mirror plane.

The neutral line 190 includes first and second opposite end portions 191, 193 coupled to and/or supported by respective first and second portions 131, 133 of the substrate 130 of the PCB 116. The neutral line 190 extends across a gap or spaced distance separating the first and second PCB portions 131, 133. The neutral line 190 is configured (e.g., optimized at a correct location, etc.) to have sufficient isolation at low band without affecting isolation of the high band. The neutral line 190 (e.g., patch, etc.) is spaced apart from and proximity couples to the ground plane 120. The neutral line 190 is operable for improving isolation of the low band.

The ground plane 120 may be configured (e.g., slanted, shaped, etc.) to reduce null and provide better radiation pattern for azimuth plane. As shown in FIG. 5, the ground plane 120 may include first and second (or left and right) portions 160, 162. The angle of the side or edge 164, 166 of the ground plane portions 160, 162, respectively, that overlap the corresponding radiator or antenna element 124, 126 is important for the radiation pattern at azimuth plane. The ratio between the radiator length and the ground plane length are important for the radiation pattern at azimuth plane. By way of example, the edge angle of the surfaces 164, 166 relative to the other sides of the ground plane portions 160, 162 may be about 43 degrees in exemplary embodiments.

The ground plane 120 includes portions or extensions 168 that extend outwardly from the ground plane 120 to increase the size of the ground plane 120. These extensions 168 electrically lengthen the ground plane 120.

The ground plane 120 includes first and second slots 170, 171 (e.g., broadly opening) in the edges 164, 166 of the respective first and second ground plane portions 160, 162. The first slot 170 is operable for increasing the electrical path of the edge 164 of the ground plane portion 160 that electrically makes the feeding move towards the edge relatively thereby increasing radiation resistance. The second slot 171 is operable for increasing the electrical path of the edge 166 of the second ground plane portion 162 that electrically makes the feeding move towards the edge relatively thereby increasing radiation resistance. In this exemplary embodiment, the slots 170, 171 are generally rectangular open ended slots that extend generally perpendicular to and inwardly from the edges or sides 164, 166, respectively. Alternatively, the slots 170, 171 may be configured differently, e.g., with a different shape, at a different location, with a different orientation relative to or non-perpendicular to the edges or sides 164, 166, etc.

Generally, the slots 170, 171 are an absence of electrically-conductive material in the ground plane 120. For example, the ground plane 120 may be initially formed with the slots 170, 171, or the slots 170, 171 may be formed by removing electrically-conductive material from the ground plane 120, such as etching, cutting, stamping, etc.

As shown in FIG. 5, the ground plane 120 may include slots 185 (broadly, openings) adjacent and/or along opposite sides of the feeding ground points 184. The braid of the cables 132 may be soldered to ground plane exposed solder pads. The slots 185 may be configured to improve bandwidth especially for the high band. In addition, the slots 185 may also be configured to reduce the surface for soldering to reduce the risk of higher PIM level. The slots 185 may be generally rectangular and aligned or parallel with each other. Alternatively, the slots may be configured differently, e.g., with a different shape, at a different location, with a different orientation relative to each other, etc.

Other exemplary embodiments may not need or include any such optional slots 185, such as when the antenna is well matched at the high band. For better PIM performance, the opening of the copper for the braid of the cable may be slightly larger than the braid outer diameter such that a gap is defined therebetween where conductor-to-conductor contact is avoided. For example, FIG. 14 shows a gap 492 defined between a cable braid 494 and a soldering pad 496.

As shown in FIG. 4, each antenna element or radiator 124, 126 includes a main or first radiating element or arm 176 configured to be operable to excite the antenna element or radiator 124, 126 to resonate at low band down to a lowest operating frequency, e.g., 698 MHz or 600 MHz, etc. Each antenna element or radiator 124, 126 further includes two high band (or second and third) radiating elements or arms 178 and 180. The high band radiating element or arm 178 is configured to be operable to excite the resonator 124, 126 to resonate at high band from 1350 MHz to 1710 MHz. The other high band radiating element or arm 180 is configured to be operable to excite the radiator 124, 126 to resonate at high band from 1710 MHz to 4200 MHz and above. The high band radiating elements 178 and/or 180 may have a sufficient length to maintain or improve omnidirectionality, as a shorter length may provide a greater bandwidth at the expense of the radiation pattern. The gap between the arms and the ground plane affect the matching of the antenna especially the high band. For example, FIG. 13 shows multiple steps that determine how wide the bandwidth is or how low the VSWR at certain high band range, e.g., high band may cover from 1350-6000 MHz with VSWR<1.8, or 1350-1550 MHz with VSWR<1.8, or 1690-2700 MHz with VSWR<1.5, or 3300-4200 MHz with VSWR<1.7, etc.

FIG. 4 also shows a microstrip line 182 extending from each antenna element or radiator 124 or 126. The width of the microstrip lines 182 may be used to match the impedance of the antenna 100. Therefore, the microstrip lines 182 may not necessarily be designed with characteristic impedance at 50 Ohms. FIG. 15 shows a matching stub 597 introduced to the transmission line to match better at the frequency range from 1690 MHz to 2700 MHz. FIG. 15 also shows the radiator having additional multiple steps 599, which may allow for improved VSWR and bandwidth.

Feed cables 132 may be electrically coupled (e.g., soldered, etc.) to the feeding ground points 184 (FIG. 5) along the back side of the PCB 116. The feed cables 132 may also be electrically coupled to the corresponding radiators 124, 126 on the opposite front side of the PCB 116. In this exemplary embodiment, the PCB 116 includes holes 186 (FIG. 4) through which the center cores of the feed cables 132 may extend for electrical connection to the microstrip electrical transmission lines 182, which, in turn, may be electrically coupled to the radiators 124, 126.

In this exemplary embodiment, the upper portion 123 of the ground plane 120, the radiators 124 and 126, and the microstrip lines 182 comprise electrically-conductive traces (e.g., copper, etc.) along the PCB 116. Alternatively, the upper ground plane portion 123, radiators 124, 126, and/or microstrip line 182 may comprise other electrically-conductive elements besides copper traces on a PCB, e.g., elements fabricated via stamping parts, plastic plating methods, constructed from sheet metal by cutting, stamping, etching, etc.

The PCB 116 may include a circuit board substrate 130 made of flame retardant 4 (FR4) glass-reinforced epoxy laminate, etc. Additionally, or alternatively, the antenna 100 may include a flexible or rigid substrate, a plastic carrier, an insulator, a flexible circuit board, a flex-film, etc. The laminate material selected may be low PIM rated for low PIM rated product where the quality of the copper foil surface may need to be carefully selected.

FIGS. 6(*d*) and 7 illustrate an antenna 200 according to another exemplary embodiment that includes a printed circuit board (PCB) 216 having radiators or antenna radiating elements 224, 226. In this exemplary embodiment, the radiators or antenna radiating elements 224, 226 are provided with additional steps 292, 294 (FIG. 7) for improved VSWR and bandwidth/frequency range. See also FIG. 13 showing radiators or antenna radiating elements provided with additional steps. Other than these additional steps 292, 294, the antenna 200 may include features similar or substantially identical to the corresponding features 100 of the antenna 100 described above and shown in FIGS. 1 through 5.

For example, the PCB 216 also includes first and second radiators or antenna elements 224, 226 and a ground plane 220 along opposite first and second (or front and back) sides of a substrate 230 of the PCB 216. Also shown in FIG. 7 are microstrip transmission lines 282, a proximity coupling neutral line 290, and ground plane extension arms 222. The PCB 216 may be configured (e.g., shaped, split, have a bowtie or butterfly shape defined by left and right PCB portions 231 and 233, etc.) to reduce the amount of PCB material to thereby help reduce wastage and costs.

As shown in FIG. 7, each antenna element or radiator 224, 226 includes a main or first radiating element or arm 276 configured to be operable to excite the antenna element or radiator 224, 226 to resonate at low band down to 698 MHz, 600 MHz, etc. Each antenna element or radiator 224, 226 further includes two high band (or second and third) radiating elements or arms 278 and 280 for resonating at high band. Each antenna element or radiator 224, 226 further includes additional steps 292, 294 for improved VSWR and bandwidth/frequency range. In this exemplary embodiment, the high band radiating elements or arms 278, 280 with the additional steps 292, 294 may be configured to be operable to excite the resonators 224, 226 to resonate at high band from about 1350 MHz to about 6000 MHz. The high band radiating elements 278 and/or 280 may have a sufficient length to maintain or improve omnidirectionality, as a shorter length may provide a greater bandwidth at the expense of the radiation pattern. And, the gap between the arms and the ground plane affect the matching of the antenna especially the high band.

FIGS. 8 and 9 illustrates another exemplary embodiment of an antenna 300 embodying one or more aspects of the present disclosure. In this exemplary embodiment, the antenna 300 comprises a low profile omnidirectional ceiling mount MIMO antenna configured to be operable within a first or low frequency range or bandwidth (e.g., from about 600 Megahertz (MHz) to about 960 MHz, etc.) and a second or high frequency range or bandwidth (e.g., from about 1350 MHz to about 4200 MHz, etc.).

The antenna 300 includes a radome or cover 308 (e.g., a plastic flat round or circular radome, etc.) and a baseplate or support member 312 (e.g., plastic baseplate, etc.). FIG. 8 provides exemplary dimensions (in millimeters) for the radome 308 and baseplate 312. The radome 308 may be circular with a diameter of 270 mm and low profile with a height of 7.6 mm. The baseplate 312 may also be circular with a diameter of 270 mm. The dimensions in this paragraph (and elsewhere in this application and the drawings) are provided for purposes of illustration only according to exemplary embodiments as alternative embodiments may be configured differently, e.g., smaller, larger, etc.

The radome 308 and baseplate 312 cooperatively define an interior in which a printed circuit board (PCB) 316 is positioned. The baseplate 312 may be configured for holding the antenna components. The radome 308 and baseplate 312 are configured to protect the PCB 316 and electrically-conductive elements (e.g., ground plane 320, ground plane extension arms 322, antenna elements or radiators 324 and 326, microstrip lines 382, neutral line 390, etc.) from damage, e.g., due to environmental conditions, etc. The radome 308 and baseplate 312 may be formed from a wide range of materials, such as, for example, thermoplastic materials (e.g., polycarbonate blends, Acrylonitrile-Butadiene-Styrene (ABS), Polycarbonate-Acrylonitrile-Butadiene-Styrene Copolymer (PC/ABS) blend, etc.), glass-reinforced plastic materials, synthetic resin materials, other dielectric materials, etc. within the scope of the present disclosure.

As shown in FIG. 8, the baseplate 312 includes a threaded stud feature 328 (broadly, a mounting feature or fixture) for installing the antenna 100 to a ceiling (broadly, a mounting surface) with a plastic nut. In this example, the baseplate 312 may integrally include the threaded stud feature 328 such that the baseplate 312 and threaded stud feature 328 have a single-piece construction. Alternatively, the threaded stud feature 328 may instead be attached (e.g., adhesively attached, mechanically fastened, etc.) to the baseplate 312.

The threaded stud feature 328 is generally hollow such that two feed cables 332 (e.g., coaxial cables, other transmission lines, etc.) may be fed through the hollow interior of the threaded stud feature 328 to respective feed points of the antenna 300. The feed cables 332 may be coaxial cables or low PIM rated coaxial cables that provide better PIM performance. A low PIM rated cable may include or use a pigtail cable as compared to a fixed connector having less freedom of matching the antenna 300. By way of example, the feed cables 332 may comprise coaxial cables having a 30 centimeter or 12 inch length with type N-female/4.3-10 female connectors. The feed points may be located at or towards a center of the radome 308 and baseplate 312. This allows the feed points to be located within or overlap the hollow interior of the threaded stud feature 328 that is located at the center of the antenna 300.

Antenna radiating elements or radiators 324, 326 (FIG. 9) and a ground plane 320 are along opposite first and second (or front and back) sides of a substrate 330 of the PCB 316. The ground plane 320 of the antenna 300 may be similar to the ground plane 120 of the antenna 100 shown in FIG. 5 although the ground extension arms 322 may be configured (e.g., shaped, sized, etc.) differently.

Also shown in FIG. 9 are a proximity coupling neutral line 390 and ground plane extension arms 322 to improve isolation between the two ports. In this exemplary embodiment, the PCB 316 may be configured (e.g., shaped, split, have a bowtie or butterfly shape defined by first and second PCB portions 331 and 333, etc.) to reduce the amount of PCB material to thereby help reduce wastage and costs.

The ground plane 320 may comprise a slanted PCB ground plane for better radiation pattern omnidirectionality as compared to a conventional dipole antenna. The ground plane 320 may include a slant cutout 336 that may allow the radiating elements 324, 326 to be positioned closer to each other. The slant cutout 336 may be defined between spaced-apart first and second lower portions of the ground plane 320.

The ground plane extension arms 322 may be configured to lower or reduce the lower operating frequency of the antenna 300. The lower portion 321 of the ground plane 320 and the ground plane extension arms 322 may comprise electrically-conductive tape and/or foil (e.g., aluminum foil tape, etc.). The electrically-conductive tape and/or foil may be proximity ground coupled to and partially overlapping an upper portion 323 of the ground plane 320 that is on the PCB 316. Accordingly, the ground plane 320 may comprise the first or upper portion 323 defined by a ground plane on the PCB 316 and the second or lower portion 321 and extension arms 322 defined by electrically-conductive tape and/or foil (e.g., aluminum foil tape, etc.). Alternatively, the second or lower ground plane portion 321 and ground plane extension arms 322 may comprise a ground plane on the PCB 316 or another PCB.

The ground plane extension arms 322 may be configured with an angle 336 (e.g., 9.41° as shown in FIG. 6), etc.) therebetween, with a low overlap, and without being directly connected. The slant angle 336 may be determined (e.g., optimized, etc.) for better isolation. The ground plane extension arms 322 may be disposed within a relatively limited area and configured with dimensions and angles so as to not affect the isolation between the first and second radiators or antenna radiating elements 324, 326.

As shown in FIG. 9, the arrangement is symmetrical with the dipoles perpendicular to each other with 90 degrees therebetween, such that the antenna 300 has a perpendicular dipole arrangement. The first and second radiators 324, 326 (and feedlines 382) are configured to be mirror images of each other, such that the first radiator or antenna element 324 is a mirror image (in a mirror plane) of the second radiator or antenna element 326. The first and second antenna elements 324, 326 may appear almost identical but be reversed in a direction perpendicular to a mirror surface. Accordingly, the first radiator 324 may correspond in mirror image relation to the second radiator 326.

The ground plane 320 may include first and second (or left and right) ground plane portions configured to be mirror images of each other. The ground plane extension arms 322 may be configured to be mirror images of each other. In this exemplary embodiment, the ground plane 320 includes a bridge portion 327 extending between the lower portions 321 of the ground plane 320, which are separated by the slant cutout 336. The bridge 327 may allow for additional improvement of the VSWR and isolation for the lower frequency range. The antenna may be electrically longer with the help of the ground plane of the opposite dipole.

First and second (or left and right) PCB portions 331, 333 of the PCB substrate 330 may also be configured to be mirror images of each other, such that the first PCB portion 331 corresponds in mirror relation to the second PCB portion 333. With a perpendicular dipole arrangement with mirrored radiating and ground plane elements, the antenna 300 may thus be configured to be operable with a symmetrical radiation pattern between the two ports at mirror plane.

The neutral line 390 includes first and second opposite end portions 391, 393 coupled to and/or supported by respective first and second portions 331, 333 of the substrate 330 of the PCB assembly 316. The neutral line 390 extends across a gap or spaced apart distance separating the first and second PCB portions 331, 333. The neutral line 390 is configured (e.g., optimized at a correct location, etc.) to have sufficient isolation at low band without affecting isolation of the high band. The neutral line 390 (e.g., patch, etc.) proximity couples to the ground plane portions 360 and 362, where mutual coupling cancels each other that leads to better isolation performance especially for low band operation.

The ground plane 320 may be configured (e.g., slanted, shaped, etc.) to reduce null and provide better radiation pattern for azimuth plane. The ground plane 320 may also include first and second (or left and right) portions. The ground plane 320 may include portions or extensions 368 that extend outwardly from the ground plane to increase the size of and electrically lengthen the ground plane.

The ground plane 320 includes first and second slots 370, 371 (e.g., broadly opening) in the edges 364, 366 of the respective first and second ground plane portions 360, 362. The first slot 370 is operable for increasing the electrical path of the edge 364 of the ground plane portion 360 that electrically makes the feeding move towards the edge relatively thereby increasing radiation resistance. The second slot 371 is operable for increasing the electrical path of the edge 366 of the second ground plane portion 362 that electrically makes the feeding move towards the edge relatively thereby increasing radiation resistance. In this exemplary embodiment, the slots 370, 371 are generally rectangular open ended slots that extend generally perpendicular to and inwardly from the edges or sides 364, 366, respectively. Alternatively, the slots 370, 371 may be configured differently, e.g., with a different shape, at a different location, with a different orientation relative to or non-perpendicular to the edges or sides 364, 366, etc.

The ground plane 320 may include an opening that is slightly larger than the diameter of the braid of the cable such that a gap is defined therebetween where conductor-to-conductor contact is avoided. This helps to minimize or reduce the risk of having a PIM source if the soldering is not wet well when the braid is touching the soldering pad. For example, FIG. 14 shows a gap 492 defined between a cable braid 494 and a soldering pad 496.

As shown in FIG. 9, each antenna element or radiator 324, 326 includes a main or first radiating element or arm 376 configured to be operable to excite the antenna element or radiator 324, 326 to resonate at low band down to 600 MHz. Each antenna element or radiator 324, 326 further includes two high band (or second and third) radiating elements or arms 378 and 380. The high band radiating element or arm 378 is configured to be operable to excite the resonator 324, 326 to resonate at high band about in the range of 1350-1710 MHz. The other high band radiating element or arm 380 is configured to be operable to excite the radiator 324, 326 to resonate at high band from 1710-4200 MHz and above. The high band radiating elements 378 and/or 380 may have a sufficient length to maintain or improve omnidirectionality, as a shorter length may provide a greater bandwidth at the expense of the radiation pattern. The gap between the arms and the ground plane affect the matching of the antenna especially the high band.

FIG. 9 also shows a microstrip line 382 extending from each antenna element or radiator 324 or 326. The width of the microstrip lines 382 may be used to match the impedance of the antenna 300. Therefore, the microstrip lines 382 may not necessarily be designed with characteristic impedance at 50 Ohms.

Feed cables 332 may be electrically coupled (e.g., soldered, etc.) to feeding ground points along the back side of the PCB 316. The feed cables 332 may also be electrically coupled to the corresponding radiators 324, 326 on the opposite front side of the PCB 316. In this exemplary embodiment, the PCB 316 includes holes 386 (FIG. 4) through which the center cores of the feed cables 332 may extend for electrical connection to the microstrip electrical transmission lines 382, which, in turn, may be electrically coupled to the radiators 324, 326.

In this exemplary embodiment, the upper portion of the ground plane 320 on the PCB 316, the radiators 324 and 326, and the microstrip lines 382 comprise electrically-conductive traces (e.g., copper, etc.) along the PCB 316. Alternatively, the ground plane, radiators 324, 326, and/or microstrip line 382 may comprise other electrically-conductive elements besides copper traces on a PCB, e.g., elements fabricated via stamping parts, plastic plating methods, constructed from sheet metal by cutting, stamping, etching, etc.

The PCB 316 may include a circuit board substrate 330 made of flame retardant 4 (FR4) glass-reinforced epoxy laminate, etc. Additionally, or alternatively, the antenna 300 may include a flexible or rigid substrate, a plastic carrier, an insulator, a flexible circuit board, a flex-film, etc. The laminate material selected may be low PIM rated for low PIM rated product where the quality of the copper foil surface may need to be carefully selected.

The antennas (e.g., 100, 200, 300, etc.) disclosed herein may have an ultra-low profile design (e.g., a radome height or thickness of about 7.6 mm or less, etc.). For example, the dimensions of the radome 108 (FIG. 3) may be 250 mm×7.6 mm Or, for example, the dimensions of the radome 308

(FIG. 8) may be 270 mm×7.6 mm. The antennas (e.g., 100, 300, etc.) disclosed herein may be used as an in-building ceiling mounted cellular network antenna. The antennas (e.g., 100, 300, etc.) disclosed herein may be configured to be aesthetic looking, unobtrusive, and/or have an outer appearance for blending with or matching the color of the ceiling or other mounting surface for the antenna. For example, the radome (e.g., 108, 308, etc.) of the antenna may be white or other color to match or blend with the color of the ceiling (e.g., drop ceiling tiles or panels, etc.) to which the antenna may be mounted. Also, the radome may be relatively flat so that the radome will be flush against the ceiling, unobtrusive, and not protrude significantly outwardly from the ceiling after the antenna is mounted to the ceiling. The dimensions in this paragraph (and elsewhere in this application and the drawings) are provided for purposes of illustration only according to exemplary embodiments as alternative embodiments may be configured differently, e.g., smaller or larger, etc.

In an exemplary embodiment, an antenna generally includes first and second radiators and a ground plane including a first edge portion and a second edge portion. The first and second edge portions of the ground plane may be configured to be operable for reducing null at azimuth plane to thereby allow the antenna to have more omnidirectional radiation patterns for the azimuth plane. The antenna may be configured to have an asymmetrical perpendicular dipole configuration.

A neutral line may be spaced apart from and proximity coupled to the ground plane. The antenna may be configured to be operable within a first frequency range and a second frequency range that is higher than the first frequency range. The neutral line may be configured to be operable for improving isolation for the first frequency range without significantly affecting isolation for the second frequency range. The antenna may further include a printed circuit board including a substrate having first and second portions. The neutral line may include first and second opposite end portions coupled to and/or supported by the respective first and second portions of the substrate of the printed circuit board, such that the neutral line extends across a spaced distance separating the first and second portions of the substrate.

The ground plane may comprises first and second ground plane extension arms configured to reduce a lower operating frequency of the antenna.

The ground plane may comprise a slant cutout defined between spaced-apart first and second lower portions of the ground plane. The ground plane may include a bridge portion extending between the spaced-apart first and second lower portions of the ground plane.

The ground plane may comprise first and second ground plane extension arms. A slant cutout may be defined between spaced-apart first and second lower portions of the ground plane. A bridge portion may extend between the spaced-apart first and second lower portions of the ground plane.

The ground plane may include first and second ground plane portions that respectively include the first and second edge portions. The first and second ground plane portions may be configured such that the first ground plane portion corresponds in mirror image relation to second ground plane portion.

In an exemplary embodiment, an antenna generally includes first and second radiators and a ground plane. The antenna may further include a neutral line spaced apart from and proximity coupled to the ground plane. The ground plane may include first and second ground plane extension arms configured to reduce a lower operating frequency of the antenna. A slant cutout may be defined between spaced-apart first and second lower portions of the ground plane.

The antenna may be configured to be operable within a first frequency range and a second frequency range that is higher than the first frequency range. The neutral line may be configured to be operable for improving isolation for the first frequency range without significantly affecting isolation for the second frequency range.

The antenna may further include a printed circuit board including a substrate having first and second portions. The neutral line may include first and second opposite end portions coupled to and/or supported by the respective first and second portions of the substrate of the printed circuit board, such that the neutral line extends across a spaced distance separating the first and second portions of the substrate.

The ground plane may include a bridge portion extending between the spaced-apart first and second lower portions of the ground plane.

In an exemplary embodiment, an antenna generally includes first and second radiators and a ground plane. The ground plane includes first and second ground plane extension arms, a slant cutout defined between spaced-apart first and second lower portions of the ground plane, and a bridge portion extending between the spaced-apart first and second lower portions of the ground plane.

The antenna may further include a neutral line spaced apart from and proximity coupled to the ground plane.

The antenna may be configured to be operable within a first frequency range and a second frequency range that is higher than the first frequency range. The neutral line may be configured to be operable for improving isolation for the first frequency range without significantly affecting isolation for the second frequency range.

The antenna may further include a printed circuit board including a substrate having first and second portions. The neutral line may include first and second opposite end portions coupled to and/or supported by the respective first and second portions of the substrate of the printed circuit board, such that the neutral line extends across a spaced distance separating the first and second portions of the substrate.

The first and second ground plane extension arms may be configured to reduce a lower operating frequency of the antenna.

In exemplary embodiments, the antenna may be configured to be symmetrical design between at least two ports. The antenna may be configured to be operable with similar and/or symmetrical radiation patterns in opposite directions with reference to a mirror plane. The antenna may be configured to be symmetrical about at least two ports of the antenna with a perpendicular dipole arrangement.

In exemplary embodiments, the first and second radiators may be configured such that the first radiator corresponds in mirror image relation to the second radiator.

In exemplary embodiments, a printed circuit board (PCB) may include first and second PCB portions along which are respectively positioned the first and second radiators. The first and second PCB portions may be configured such that the first PCB portion corresponds in mirror image relation to the second PCB portion.

In exemplary embodiments, the antenna may include first and second microstrip electrical transmission lines. The first microstrip electrical transmission line may extend between the first radiator and a first feed point. The second microstrip electrical transmission line may extend between the second radiator and a second feed point. The first and second microstrip electrical transmission lines may be configured such that the first microstrip electrical transmission line corresponds in mirror image relation to the second microstrip electrical transmission line.

In exemplary embodiments, the antenna may be configured to be operable with a symmetrical radiation pattern between two ports at mirror plane and/or with good isolation performance between the two ports.

In exemplary embodiments, the antenna may include an electrically-conductive tape and/or foil defining at least part of the ground plane.

In exemplary embodiments, the antenna may include a substrate having opposite front and back sides. The first and second radiators may be along the front side of the substrate. The ground plane may include first and second ground plane portions. The first ground plane portion may be along a back side of the substrate. The second ground plane portion may include an electrically-conductive tape and/or foil that overlaps the first ground plane portion to thereby provide proximity coupling between the electrically-conductive tape and/or foil and the first ground plane portion.

In exemplary embodiments, the antenna may include a baseplate including a mounting feature for mounting the antenna to a mounting surface and a radome coupled to the baseplate. The first and second radiators and the ground plane may be positioned within an interior cooperatively defined between the radome and the baseplate. The mounting feature may include a hollow interior to allow coaxial feed cables to be fed through the hollow interior to corresponding feeding ground points located within the interior cooperatively defined between the radome and the baseplate. The feed points may be adjacent a center of the radome and/or positioned within or overlapping the hollow interior of the mounting feature of the baseplate.

In exemplary embodiments, each of the first and second radiators may include first, second, and third radiating elements. The first radiating element may be configured to be operable to excite the first or second radiator to resonate at low band. The second radiating element may be configured to be operable to excite the first or second radiator to resonate at a first high band. The third radiating element may be configured to be operable to excite the first or second radiator to resonate at a second high band higher than the first high band.

In exemplary embodiments, the antenna may be configured to be operable omnidirectionally in the azimuth plane, with a voltage standing wave ratio (VSWR) of less than 2:1 and/or with a passive intermodulation (IM3) less than −150 decibels relative to carrier (dBc) within a first frequency range and a second frequency range. The first frequency range may be from about 698 MHz to about 960 MHz, and the second frequency range may be from about 1690 MHz to about 4200 MHz. Or, the first frequency range may be from about 600 MHz to about 960 MHz, and the second frequency range may be from about 1690 MHz to about 4200 MHz. Or, the first frequency range may be from about 600 MHz to about 960 MHz, and the second frequency range may be from about 1350 MHz to about 6000 MHz.

In exemplary embodiments, a low profile omnidirectional ceiling mount multiple-input multiple output antenna assembly generally includes a radome and an antenna as disclosed herein. The radome may have a height of about 7.6 millimeters or less. The radome may comprise a circular radome having a diameter of about 250 millimeters or 270 millimeters.

APPENDIX A

Figure 1:
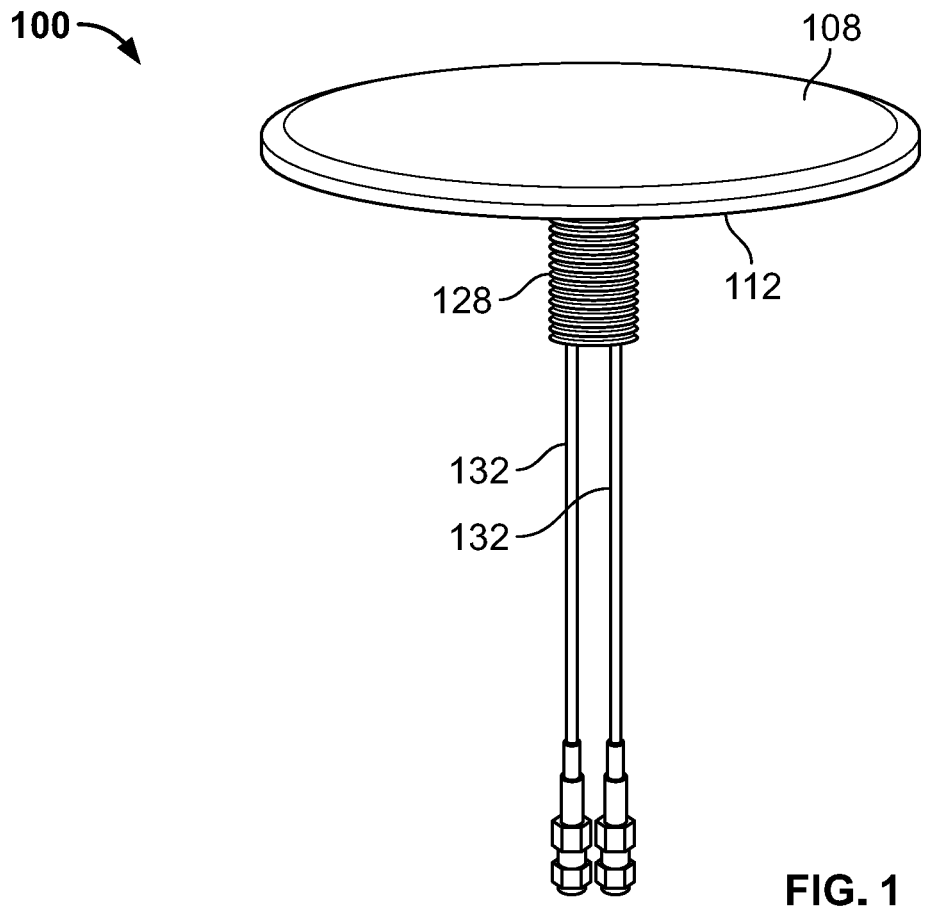
FIG. 1 is a perspective view of an antenna according to an exemplary embodiment.

Appendix A includes simulated performance results and characteristics for an antenna as shown in FIGS. 1, 4, and 5. The entire disclosure of Appendix A is incorporated herein by reference. The contents of Appendix A, however, are provided only for purposes of illustration and not for purposes of limitation as other exemplary embodiments may be configured differently and/or have different performance results and/or characteristics.

Appendix A includes a table of simulated antenna characteristics for an antenna as shown in FIGS. 1, 4, and 5. For this simulation, the antenna had two ports, a 30 centimeter or 12 inch long coaxial cable length, a type N-female/4.3-10 female connector, a diameter of about 250 mm, and a height of about 7.6 mm. As shown in the table, the antenna characteristics for a first or low band frequency range from 698 MHz to 960 MHz and a second or high band frequency range from 1710 MHz to 4200 MHz included a simulated VSWR of less than 1.6:1, maximum passive intermodulation (IM3) (PIM, $3^{rd}$ order, 2×20 W) of 150 decibels relative to carrier (dBc), and an isolation of less than −15 dB. The antenna characteristics also included a maximum peak gain of 3 decibels relative to isotropic (dBi) for frequencies from 698 MHz to 960 MHz, a maximum peak gain of 4.9 dBi for frequencies from 1710 MHz to 2700 MHz, and a maximum peak gain of 6 dBi for frequencies from 3300 MHz to 4200 MHz.

Appendix A also includes an exemplary line graph of simulated voltage standing wave ratio (VSWR) versus frequency in gigahertz (GHz) for an antenna as shown in FIGS. 1, 4, and 5. Generally, the VSWR line graph shows that the antenna is operable with good VSWR of less than 1.6:1 for frequencies within a first frequency range from about 698 MHz to about 960 MHz and for frequencies within a second frequency range from about 1690 MHz to about 4200 MHz. For example, the VSWR was 1.356 at 690 MHz, 1.3927 at 960 MHz, 1.4188 at 1690 MHz, 1.38 at 2700 MHz, 1.2011 at 3300 MHz, and 1.5206 at 3800 MHz.

Appendix A includes an exemplary line graph of simulated return loss (S1,1) and isolation (S2,1) in decibels (dB) versus frequency (GHz) for an antenna as shown in FIGS. 1, 4, and 5. Generally, the line graph shows that the antenna is operable with good return loss (e.g., less than negative 15 dB, etc.) and good isolation (e.g., less than negative 15 dB, etc.) for frequencies within a first frequency range from about 698 MHz to about 960 MHz and for frequencies within a second frequency range from about 1690 MHz to about 4200 MHz. For example, the return loss (S1,1) was −16.45 dB at 690 MHz, −14.47 dB at 960 MHz, −17.81 dB at 1350 MHz, −17.029 dB at 2700 MHz, −22.903 dB at 3300 MHz, −14.695 dB at 3800 MHz, −10.679 dB at 5300 MHz, and −10.197 dB at 5850 MHz. The isolation (S2,1) was −17.707 dB at 698 MHz, −17.384 dB at 806 MHz, and −19.901 dB at 960 MHz.

Appendix A includes an exemplary line graph of simulated gain versus frequency (GHz) for an antenna as shown in FIGS. 1, 4, and 5. Generally, the line graph shows that the antenna is operable with good gain for frequencies within a first frequency range from about 698 MHz to about 960 MHz and for frequencies within a second frequency range from about 1690 MHz to about 4200 MHz.

Appendix A includes simulated radiation patterns of far-field realized gain abs for Theta 90° and Phi 90° for a single port of a 2-port antenna as shown in FIGS. 1, 4, and 5 at frequencies of 698 MHz, 715 MHz, 824 MHz, 850 MHz, 960 MHz, 1350 MHz, 1575 MHz, 1690 MHz, 1850 MHz, 1990 MHz, 2700 MHz, 3300 MHz, and 3800 MHz. Generally, these radiation patterns show the reasonable omnidirectional radiation patterns and good efficiency of the 2-port antenna as shown in FIGS. 1, 4, and 5 within a first frequency range from about 698 MHz to about 960 MHz and a second frequency range from about 1350 MHz to about 4200 MHz.

APPENDIX B

Appendix B includes measured performance results and characteristics for an antenna as shown in FIGS. 6(*d*) and 7. The entire disclosure of Appendix B is incorporated herein by reference. The contents of Appendix B, however, are provided only for purposes of illustration and not for purposes of limitation as other exemplary embodiments may be configured differently and/or have different performance results and/or characteristics.

Appendix B includes a table of antenna characteristics for an antenna as shown in FIGS. 6(*d*) and 7. As shown in the table, the antenna characteristics for a first or low band frequency range from 698 MHz to 960 MHz and a second or high band frequency range from 1350 MHz to 4200 MHz included an isolation of less than −15 dB, nominal impedance of 50 Ohms, horizontal polarization, and an azimuth beam width of 360 degrees, omnidirectional.

The antenna characteristics also included:

- maximum peak gain of 1.5 to 3 decibels relative to isotropic (dBi) and VSWR less than 1.5:1 for frequencies from 698 MHz to 960 MHz;
- maximum peak gain of 2.3 to 5.7 dBi for frequencies from 880 MHz to 2700 MHz;
- VSWR less than 1.8:1 for frequencies from 1350 MHz to 1550 MHz;
- VSWR less than 1.5:1 for frequencies from 1690 MHz to 2700 MHz; and
- maximum peak gain of 4 to 6 dBi and VSWR less than 1.8:1 for frequencies from 3300 MHz to 4200 MHz.

Appendix B also includes an exemplary line graph of measured voltage standing wave ratio (VSWR) and isolation versus frequency in gigahertz (GHz) for an antenna as shown in FIGS. 6(*d*) and 7. Generally, the VSWR line graphs show that the antenna is operable with good VSWR for both ports (S11, S22) of less than 1.8:1 for frequencies within a first frequency range from about 698 MHz to about 960 MHz and for frequencies within a second frequency range from about 1350 MHz to about 4900 MHz. For example, the VSWR for ports 1 and 2 was 1.6 and 1.58 at 698 MHz, 1.27 and 1.31 at 806 MHz, 1.11 and 1.1 at 960 MHz, 1.25 and 1.26 at 1690 MHz, 1.35 and 1.43 at 2400 MHz, 1.28 and 1.24 at 2700 MHz, 1.19 and 1.07 at 3300 MHz, and 1.78 and 1.61 at 4900 MHz.

Generally, the isolation (S21) line graph shows that the antenna had good isolation of less than −15 dB for frequencies within a first frequency range from about 600 MHz to about 960 MHz and for frequencies within a second frequency range from about 1690 MHz to about 4900 MHz. For example, the isolation was −20.3 dB at 600 MHz, −20.2 dB at 698 MHz, −21.3 dB at 806 MHz, −20.5 dB at 960 MHz, −15.5. dB at 1690 MHz, −28.7 dB at 2400 MHz, −40.1 dB at 2700 MHz, −37.1 dB at 3300 MHz, and −30.1 dB at 4900 MHz.

Appendix B includes measured radiation patterns (Azimuth Plane, Phi 0° Plane, and Theta 0° Plane) for the antenna as shown in FIGS. 6(*d*) and 7 at frequencies of 698 MHz, 746 MHz, 824 MHz, 880 MHz, 960 MHz, 1350 MHz, 1448 MHz, 1550 MHz, 1690 MHz, 1730 MHz, 1850 MHz, 1930 MHz, 2130 MHz, 2310 MHz, 2412 MHz, 2510 MHz, 2600 MHz, 2700 MHz, 2900 MHz, 3300 MHz, 3500 MHz, 3800 MHz, and 4000 MHz. Generally, these radiation patterns show the reasonable omnidirectional radiation patterns and good efficiency of the antenna as shown in FIGS. 6(*d*) and 7 within a first frequency range from about 698 MHz to about 960 MHz and a second frequency range from about 1350 MHz to about 4200 MHz.

Appendix B includes line graphs of measured PIM results (in dBc) versus frequency (in MHz) for Ports 1 and 2 for the antenna as shown in FIGS. 6(*d*) and 7 at 2TX 20 W at 728 MHz to 757 MHz and at 1930 MHz to 1990 MHz. Generally, these line graphs show that the antenna had acceptably low PIM. For example, the antenna had a maximum PIM of −159.5 dBc at 781 MHz for Port, maximum PIM of −158.6 dBc at 1896 MHz for Port 1, maximum PIM of −158.7 dBc at 781 MHz for Port 2, and maximum PIM of −160.6 dBc at 1894 MHz for Port 2.

APPENDIX C

Appendix C includes measured performance results and characteristics for an antenna as shown in FIGS. 8 and 9. The entire disclosure of Appendix C is incorporated herein by reference. The contents of Appendix C, however, are provided only for purposes of illustration and not for purposes of limitation as other exemplary embodiments may be configured differently and/or have different performance results and/or characteristics.

Appendix C includes a table of antenna characteristics for an antenna as shown in FIGS. 8 and 9. As shown in the table, the antenna characteristics for a first or low band frequency range from 698 MHz to 960 MHz and a second or high band frequency range from 1350 MHz to 4200 MHz included an isolation of less than −15 dB, nominal impedance of 50 Ohms, horizontal polarization, and an azimuth beam width of 360 degrees, omnidirectional.

The antenna characteristics also included:

- maximum peak gain of 1.5 to 3 decibels relative to isotropic (dBi) for frequencies from 600 MHz to 894 MHz;
- maximum peak gain of 2.3 to 5.7 dBi for frequencies from 880 to 960 MHz and 1350 MHz to 2700 MHz;
- maximum peak gain of 4 to 5.7 dBi for frequencies from 3300 MHz to 4200 MHz;
- VSWR less than 1.5:1 for frequencies from 600 MHz to 960 MHz;
- VSWR less than 1.8:1 for frequencies from 1350 MHz to 1550 MHz;
- VSWR less than 1.5:1 for frequencies from 1690 MHz to 2700 MHz; and
- VSWR less than 1.8:1 for frequencies from 3300 MHz to 4200 MHz.

Appendix C also includes an exemplary line graph of measured voltage standing wave ratio (VSWR) and isolation versus frequency in gigahertz (GHz) for an antenna as shown in FIGS. 8 and 9. Generally, the VSWR line graphs show that the antenna is operable with good VSWR for both ports (S11, S22) of less than 1.8:1 for frequencies within a first frequency range from about 600 MHz to about 960 MHz and for frequencies within a second frequency range from about 1690 MHz to about 3300 MHz. For example, the VSWR for ports 1 and 2 was 1.43 and 1.52 at 600 MHz, 1.05 and 1.05 at 698 MHz, 1.29 and 1.18 at 806 MHz, 1.13 and 1.13 at 960 MHz, 1.34 and 1.31 at 1690 MHz, 1.44 and 1.43 at 2400 MHz, 1.43 and 1.43 at 2700 MHz, and 1.36 and 1.31 at 3300 MHz.

Generally, the isolation (S21) line graph shows that the antenna had good isolation of less than −15 dB for frequencies within a first frequency range from about 600 MHz to about 960 MHz and for frequencies within a second frequency range from about 1690 MHz to about 4900 MHz. For example, the isolation was −24.1 dB at 600 MHz, −18.4 at 698 MHz, −16.3 dB at 806 MHz, −16.8 dB at 960 MHz, −16.6 dB at 1690 MHz, −33.9 dB at 2400 MHz, −38.5 dB at 2700 MHz, −32.6 dB at 3300 MHz, and −32.6 dB at 4900 MHz.

Appendix C includes measured radiation patterns (Azimuth Plane, Phi 0° Plane, and Theta 0° Plane) for the antenna as shown in FIGS. 8 and 9 at frequencies of 600 MHz, 698 MHz, 806 MHz, 960 MHz, 1350 MHz, 1500 MHz, 1690 MHz, 1730 MHz, 1930 MHz, 2130 MHz, 2170 MHz, 2310 MHz, 2600 MHz, 2700 MHz, 3300 MHz, and 3800 MHz. Generally, these radiation patterns show the reasonable omnidirectional radiation patterns and good efficiency of the antenna as shown in FIGS. 8 and 9 within a first frequency range from about 698 MHz to about 960 MHz and a second frequency range from about 1350 MHz to about 4000 MHz.

Appendix C includes line graphs of measured PIM results (in dBc) versus frequency (in MHz) for Ports 1 and 2 for the antenna as shown in FIGS. 8 and 9 at 2TX 20 W at 728 MHz to 757 MHz and at 1930 MHz to 1990 MHz. Generally, these line graphs show that the antenna had acceptably low PIM. For example, the antenna had a maximum PIM of −159.5 dBc at 777 MHz for Port 1, maximum PIM of −157.4 dBc at 1893 MHz for Port 1, maximum PIM of −159.5 dBc at 781 MHz for Port 2, and maximum PIM of −160.9 dBc at 1893 MHz for Port 2.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna comprising:

first and second radiators;

a ground plane including a first edge portion and a second edge portion; and a neutral line spaced apart from and proximity coupled to the ground plane;

whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

wherein:

the antenna is configured to be operable within a first frequency range and a second frequency range that is higher than the first frequency range, and the neutral line is configured to be operable for improving isolation for the first frequency range without significantly affecting isolation for the second frequency range; and/or the antenna comprises a printed circuit board including a substrate having first and second portions, and the neutral line includes first and second opposite end portions coupled to and/or supported by the respective first and second portions of the substrate of the printed circuit board, such that the neutral line extends across a spaced distance separating the first and second portions of the substrate.

2. The antenna of claim 1, wherein:

the ground plane comprises first and second ground plane extension arms configured to reduce a lower operating frequency of the antenna; and/or the ground plane comprises a slant cutout defined between spaced-apart first and second lower portions of the ground plane.

3. The antenna of claim 1, wherein:

the ground plane comprises a slant cutout defined between spaced-apart first and second lower portions of the ground plane; and the antenna includes a bridge portion extending between the spaced-apart first and second lower portions of the ground plane.

4. The antenna of claim 3, wherein the ground plane comprises first and second ground plane extension arms.

5. The antenna of claim 1, wherein:

the ground plane includes first and second ground plane portions that respectively include the first and second edge portions, and the first and second ground plane portions are configured such that the first ground plane portion corresponds in mirror image relation to second ground plane portion; and/or the first and second radiators are configured such that the first radiator corresponds in mirror image relation to the second radiator.

6. The antenna of claim 1, wherein:

the antenna comprises a substrate having opposite front and back sides, the first and second radiators are along the front side of the substrate, and the ground plane includes a first ground plane portion along a back side of the substrate and a second ground plane portion comprising an electrically-conductive tape and/or foil that overlaps the first ground plane portion to thereby provide proximity coupling between the electrically-conductive tape and/or foil and the first ground plane portion; and/or;

each of the first and second radiators includes a first radiating element configured to be operable to excite the first or second radiator to resonate at low band, a second radiating element configured to be operable to excite the first or second radiator to resonate at a first high band, and a third radiating element configured to be operable to excite the first or second radiator to resonate at a second high band higher than the first high band.

7. An antenna comprising:

first and second radiators; and a ground plane including a first edge portion and a second edge portion;

whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

wherein:

the antenna comprises a printed circuit board (PCB) including first and second PCB portions along which are respectively positioned the first and second radiators, and the first and second PCB portions are configured such that the first PCB portion corresponds in mirror image relation to the second PCB portion; and/or the antenna comprises a first microstrip electrical transmission line that extends between the first radiator and a first feed point, and a second microstrip electrical transmission line that extends between the second radiator and a second feed point, the first and second microstrip electrical transmission lines being configured such that the first microstrip electrical transmission line corresponds in mirror image relation to the second microstrip electrical transmission line;

and/or the antenna comprises an electrically-conductive tape and/or foil defining at least part of the ground plane.

8. The antenna of claim 7, further comprising a neutral line spaced apart from and proximity coupled to the ground plane.

9. An antenna comprising:

first and second radiators; and a ground plane including a first edge portion and a second edge portion;

whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

wherein:

the antenna comprises a substrate having opposite front and back sides, the first and second radiators are along the front side of the substrate, and the ground plane includes a first ground plane portion along a back side of the substrate and a second ground plane portion comprising an electrically-conductive tape and/or foil that overlaps the first ground plane portion to thereby provide proximity coupling between the electrically-conductive tape and/or foil and the first ground plane portion; and/or each of the first and second radiators includes a first radiating element configured to be operable to excite the first or second radiator to resonate at low band, a second radiating element configured to be operable to excite the first or second radiator to resonate at a first high band, and a third radiating element configured to be operable to excite the first or second radiator to resonate at a second high band higher than the first high band.

10. A low profile omnidirectional ceiling mount multiple-input multiple output antenna assembly comprising:

an antenna comprising first and second radiators, and a ground plane including a first edge portion and a second edge portion, whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

a baseplate including a mounting feature for mounting the antenna to a mounting surface;

a radome coupled to the baseplate;

wherein the first and second radiators and the ground plane are positioned within an interior cooperatively defined between the radome and the baseplate;

wherein the mounting feature includes a hollow interior to allow coaxial feed cables to be fed through the hollow interior to corresponding feeding ground points located within the interior cooperatively defined between the radome and the baseplate;

wherein the feed points are adjacent a center of the radome and/or positioned within or overlapping the hollow interior of the mounting feature of the baseplate; and wherein the antenna is configured to be operable omnidirectionally in the azimuth plane, with a voltage standing wave ratio (VSWR) of less than 2:1, and/or with a passive intermodulation (IM3) less than −150 decibels relative to carrier (dBc) within a first frequency range and a second frequency range, and wherein:

the first frequency range is from about 698 MHz to about 960 MHz, and the second frequency range is from about 1690 MHz to about 4200 MHz; or the first frequency range is from about 600 MHz to about 960 MHz, and the second frequency range is from about 1690 MHz to about 4200 MHz; or the first frequency range is from about 600 MHz to about 960 MHz, and the second frequency range is from about 1350 MHz to about 6000 MHz.

11. An antenna comprising:

first and second radiators; and a ground plane including a first edge portion and a second edge portion;

whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

wherein:

the antenna comprises a neutral line spaced apart from and proximity coupled to the ground plane; and/or the ground plane comprises first and second ground plane extension arms configured to reduce a lower operating frequency of the antenna and/or a slant cutout defined between spaced-apart first and second lower portions of the ground plane;

wherein:

the antenna comprises a printed circuit board including a substrate having first and second portions; and the neutral line includes first and second opposite end portions coupled to and/or supported by the respective first and second portions of the substrate of the printed circuit board, such that the neutral line extends across a spaced distance separating the first and second portions of the substrate.

12. The antenna of claim 11, wherein:

the antenna is configured to be operable within a first frequency range and a second frequency range that is higher than the first frequency range, and the neutral line is configured to be operable for improving isolation for the first frequency range without significantly affecting isolation for the second frequency range; and/or the antenna includes a bridge portion extending between the spaced-apart first and second lower portions of the ground plane.

13. The antenna of claim 11, wherein:

the antenna is configured to be symmetrical design between at least two ports; and/or the antenna is configured to be operable with similar and/or symmetrical radiation patterns in opposite directions with reference to a mirror plane; and/or the antenna is configured to be symmetrical about at least two ports of the antenna with a perpendicular dipole arrangement; and/or the antenna comprises an electrically-conductive tape and/or foil defining at least part of the ground plane.

14. The antenna of claim 11, wherein:

the first and second portions of the substrate of the printed circuit board are first and second PCB portions along which are respectively positioned the first and second radiators, and the first and second PCB portions are configured such that the first PCB portion corresponds in mirror image relation to the second PCB portion; and/or the antenna comprises a first microstrip electrical transmission line that extends between the first radiator and a first feed point, and a second microstrip electrical transmission line that extends between the second radiator and a second feed point, the first and second microstrip electrical transmission lines being configured such that the first microstrip electrical transmission line corresponds in mirror image relation to the second microstrip electrical transmission line; and/or the first and second radiators are configured such that the first radiator corresponds in mirror image relation to the second radiator.

15. An antenna comprising:

first and second radiators; and a ground plane including a first edge portion and a second edge portion;

whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

wherein:

the antenna comprises a neutral line spaced apart from and proximity coupled to the ground plane; and/or the ground plane comprises first and second ground plane extension arms configured to reduce a lower operating frequency of the antenna and/or a slant cutout defined between spaced-apart first and second lower portions of the ground plane;

wherein:

the antenna comprises a substrate having opposite front and back sides, the first and second radiators are along the front side of the substrate, and the ground plane includes a first ground plane portion along a back side of the substrate and a second ground plane portion comprising an electrically-conductive tape and/or foil that overlaps the first ground plane portion to thereby provide proximity coupling between the electrically-conductive tape and/or foil and the first ground plane portion; and/or each of the first and second radiators includes a first radiating element configured to be operable to excite the first or second radiator to resonate at low band, a second radiating element configured to be operable to excite the first or second radiator to resonate at a first high band, and a third radiating element configured to be operable to excite the first or second radiator to resonate at a second high band higher than the first high band.

16. The antenna of claim 15, wherein:

the antenna comprises a printed circuit board including a substrate having first and second portions; and the neutral line includes first and second opposite end portions coupled to and/or supported by the respective first and second portions of the substrate of the printed circuit board, such that the neutral line extends across a spaced distance separating the first and second portions of the substrate.

17. A low profile omnidirectional ceiling mount multiple-input multiple output antenna assembly comprising:

an antenna including:

first and second radiators; and a ground plane including a first edge portion and a second edge portion;

whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

wherein:

the antenna comprises a neutral line spaced apart from and proximity coupled to the ground plane; and/or the ground plane comprises first and second ground plane extension arms configured to reduce a lower operating frequency of the antenna and/or a slant cutout defined between spaced-apart first and second lower portions of the ground plane;

a baseplate including a mounting feature for mounting the antenna to a mounting surface;

a radome coupled to the baseplate;

wherein the first and second radiators and the ground plane are positioned within an interior cooperatively defined between the radome and the baseplate;

wherein the mounting feature includes a hollow interior to allow coaxial feed cables to be fed through the hollow interior to corresponding feeding ground points located within the interior cooperatively defined between the radome and the baseplate;

wherein the feed points are adjacent a center of the radome and/or positioned within or overlapping the hollow interior of the mounting feature of the baseplate;

wherein the antenna is configured to be operable omnidirectionally in the azimuth plane, with a voltage standing wave ratio (VSWR) of less than 2:1, and/or with a passive intermodulation (IM3) less than −150 decibels relative to carrier (dBc) within a first frequency range and a second frequency range, and wherein:

the first frequency range is from about 698 MHz to about 960 MHz, and the second frequency range is from about 1690 MHz to about 4200 MHz; or the first frequency range is from about 600 MHz to about 960 MHz, and the second frequency range is from about 1690 MHz to about 4200 MHz; or the first frequency range is from about 600 MHz to about 960 MHz, and the second frequency range is from about 1350 MHz to about 6000 MHz.

18. An antenna comprising:

first and second radiators; and a ground plane including a first edge portion and a second edge portion;

whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

wherein the ground plane includes first and second ground plane extension arms; a slant cutout defined between spaced-apart first and second lower portions of the ground plane; and a bridge portion extending between the spaced-apart first and second lower portions of the ground plane;

wherein:

the antenna comprises a substrate having opposite front and back sides, the first and second radiators are along the front side of the substrate, and the ground plane includes a first ground plane portion along a back side of the substrate and a second ground plane portion comprising an electrically-conductive tape and/or foil that overlaps the first ground plane portion to thereby provide proximity coupling between the electrically-conductive tape and/or foil and the first ground plane portion; and/or;

each of the first and second radiators includes a first radiating element configured to be operable to excite the first or second radiator to resonate at low band, a second radiating element configured to be operable to excite the first or second radiator to resonate at a first high band, and a third radiating element configured to be operable to excite the first or second radiator to resonate at a second high band higher than the first high band.

19. The antenna of claim 18, further comprising a neutral line spaced apart from and proximity coupled to the ground plane.

20. The antenna of claim 19, wherein:

the antenna is configured to be operable within a first frequency range and a second frequency range that is higher than the first frequency range, and the neutral line is configured to be operable for improving isolation for the first frequency range without significantly affecting isolation for the second frequency range; and/or the antenna comprises a printed circuit board including a substrate having first and second portions, and the neutral line includes first and second opposite end portions coupled to and/or supported by the respective first and second portions of the substrate of the printed circuit board, such that the neutral line extends across a spaced distance separating the first and second portions of the substrate.

21. The antenna of claim 18, wherein:

the antenna comprises a printed circuit board (PCB) including first and second PCB portions along which are respectively positioned the first and second radiators, and the first and second PCB portions are configured such that the first PCB portion corresponds in mirror image relation to the second PCB portion; and/or the antenna comprises a first microstrip electrical transmission line that extends between the first radiator and a first feed point, and a second microstrip electrical transmission line that extends between the second radiator and a second feed point, the first and second microstrip electrical transmission lines being configured such that the first microstrip electrical transmission line corresponds in mirror image relation to the second microstrip electrical transmission line; and/or the first and second radiators are configured such that the first radiator corresponds in mirror image relation to the second radiator.

22. A low profile omnidirectional ceiling mount multiple-input multiple output antenna assembly comprising:

an antenna including:

first and second radiators; and a ground plane including a first edge portion and a second edge portion;

whereby the first and second edge portions of the ground plane are configured to be operable for reducing null at azimuth plane to thereby allow the antenna to have more omnidirectional radiation patterns for the azimuth plane, and/or whereby the antenna is configured to have an asymmetrical perpendicular dipole configuration;

wherein the ground plane includes first and second ground plane extension arms; a slant cutout defined between spaced-apart first and second lower portions of the ground plane; and a bridge portion extending between the spaced-apart first and second lower portions of the ground plane;

a baseplate including a mounting feature for mounting the antenna to a mounting surface;

a radome coupled to the baseplate;

wherein the first and second radiators and the ground plane are positioned within an interior cooperatively defined between the radome and the baseplate;

wherein the mounting feature includes a hollow interior to allow coaxial feed cables to be fed through the hollow interior to corresponding feeding ground points located within the interior cooperatively defined between the radome and the baseplate;

wherein the feed points are adjacent a center of the radome and/or positioned within or overlapping the hollow interior of the mounting feature of the baseplate;

wherein the antenna is configured to be operable omnidirectionally in the azimuth plane, with a voltage standing wave ratio (VSWR) of less than 2:1, and/or with a passive intermodulation (IM3) less than −150 decibels relative to carrier (dBc) within a first frequency range and a second frequency range, and wherein:

the first frequency range is from about 698 MHz to about 960 MHz, and the second frequency range is from about 1690 MHz to about 4200 MHz; or the first frequency range is from about 600 MHz to about 960 MHz, and the second frequency range is from about 1690 MHz to about 4200 MHz; or the first frequency range is from about 600 MHz to about 960 MHz, and the second frequency range is from about 1350 MHz to about 6000 MHz.

* * * * *